United States Patent [19]

Hirose et al.

[11] Patent Number: 4,906,555

[45] Date of Patent: Mar. 6, 1990

[54] SILVER HALIDE COLOR PHOTOGRAPHIC MATERIAL COMPRISING SPECIFIED COUPLERS AND ANTI-FADING AGENTS

[75] Inventors: Takeshi Hirose; Nobuo Furutachi; Masakazu Morigaki, all of Kanagawa, Japan

[73] Assignee: Fuji Photo Film Co., Ltd., Kanagawa, Japan

[21] Appl. No.: 267,620

[22] Filed: Nov. 3, 1988

Related U.S. Application Data

[63] Continuation of Ser. No. 918,440, Oct. 14, 1986, abandoned.

[30] Foreign Application Priority Data

Oct. 18, 1985 [JP] Japan ..... 60-231092

[51] Int. Cl.[4] ..... G03C 1/46; G03C 7/32

[52] U.S. Cl. ..... 430/505; 430/551; 430/558; 430/931

[58] Field of Search ..... 430/505, 551, 558, 931

[56] References Cited

U.S. PATENT DOCUMENTS

| | | | |
|---|---|---|---|
| 4,513,081 | 4/1985 | Okazaki et al. | 430/550 |
| 4,552,836 | 11/1985 | Tanabe et al. | 430/549 |
| 4,607,002 | 9/1986 | Nakayama et al. | 430/505 |
| 4,622,287 | 10/1986 | Umemoto et al. | 430/551 |
| 4,668,611 | 5/1987 | Nakamura | 430/505 |

*Primary Examiner*—Paul R. Michl
*Assistant Examiner*—Patrick A. Doody
*Attorney, Agent, or Firm*—Sughrue, Mion, Zinn, Macpeak & Seas

[57] ABSTRACT

A multilayer silver halide color photographic material comprising a reflective support and a blue-, green- and red-sensitive emulsion layer containing at least one yellow coupler (represented by the general formula (I)), magenta coupler (represented by the general formula (II)), and cyan coupler (represented by the general formula (III)), respectively, and the blue-sensitive emulsion layer also contains at least one compound represented by the general formulae (A) or (B), all compounds are as disclosed in the specification.

9 Claims, No Drawings

SILVER HALIDE COLOR PHOTOGRAPHIC MATERIAL COMPRISING SPECIFIED COUPLERS AND ANTI-FADING AGENTS

This is a continuation of application Ser. No. 06/918,440, filed October 14, 1986, now abandoned.

BACKGROUND OF THE INVENTION

The present invention relates to a silver halide color photographic material and, more particularly, to a color paper which is improved in color reproductivity and color image fastness.

In a silver halide color photographic material is often employed a system utilizing a light-sensitive silver halide emulsion and a so-called dye forming coupler (hereinafter abbreviated to a "coupler") that forms a dye on reacting with an oxidized product of an aromatic primary amine developer. Usually, a combination of a yellow coupler, a cyan coupler and a magenta coupler is used.

A 5-pyrazolone-based coupler often used as a magenta coupler has a sub-absorption in the neighborhood of 430 nm and is not sharply terminated in the long wavelength side, and thus has a serious problem in color reproduction.

In order to overcome the above problem, a pyrazoloazole-based magenta coupler has been developed. It has been found that a magenta dye obtained as a result of coupling between this type of coupler and an oxidized product of an aromatic primary amine developer does not have a sub-absorption in the neighborhood of 430 nm in the form of an ethyl acetate solution and forms a magenta color which is sharply terminated in the long wavelength side absorption and is of high purity. A multilayer silver halide color photographic material such as a multilayer color paper using such a pyrazoloazole-based magenta coupler is excellent in color reproductivity, but the light fastness of a yellow dye formed therein is somewhat inferior.

As a result of extensive investigation, it has been found that the cause of the yellow fading is that a dye formed from the coupler does not have a sub-absorption in the short wavelength side. That is, it has been found that a multilayer color paper generally comprises a reflective support and a blue-sensitive silver halide emulsion layer containing a yellow coupler, a green-sensitive silver halide emulsion layer containing a magenta coupler, and a red-sensitive silver halide emulsion layer; when a pyrazoloazole type magenta coupler is used in a green-sensitive emulsion layer and a diacylaminocyan coupler providing a dye having good storage stability as represented by the general formula (III) as described hereinafter is used in a red-sensitive emulsion layer, a magenta dye image formed in the green-sensitive emulsion layer does not have a sub-absorption in the short wavelength side as described above, and a cyan dye image formed in the red-sensitive emulsion layer is decreased in blue light absorption and, therefore, the filter effect onto a yellow dye formed in the blue-sensitive emulsion layer below the above emulsion layers is decreased and the light fastness of the yellow image is reduced.

The present inventors, therefore, have made extensive investigations to develop a multilayer color paper which is excellent in color reproductivity and color image light fastness, by using a pyrazoloazole-based magenta coupler providing a high purity magenta dye and a diacylamino-based cyan coupler providing a dye of high stability with time.

SUMMARY OF THE INVENTION

An object of the present invention is to provide a multilayer color paper which is excellent in color reproductivity and color image light fastness, by using a pyrazoloazole-based magenta coupler.

In particular, an object of the present invention is to provide a multilayer color paper which is excellent in color reproductivity and color image light fastness, by using a pyrazoloazole-based magenta coupler which does not have a sub-absorption and is sharp in the absorption at the long wavelength side and of high color purity, and specified cyan and yellow couplers capable of providing a color image which is excellent particularly in color reproductivity.

The present invention relates to a multilayer silver halide color photographic material comprising a reflective support and a blue-sensitive emulsion layer containing at least one yellow coupler represented by the general formula (I), a green-sensitive emulsion layer containing at least one magenta coupler represented by the general formula (II) and a red-sensitive emulsion layer containing at least one cyan coupler represented by the general formula (III), wherein the blue-sensitive emulsion layer further contains at least one compound represented by the general formulae (A) or (B).

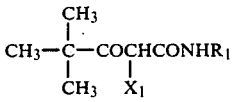

(I)

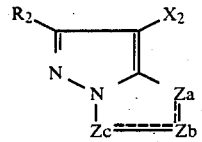

(II)

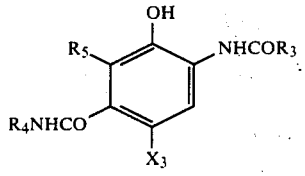

(III)

In the general formulae (I), (II) and (III), $R_1$, $R_2$, $R_3$, $R_4$ and $R_5$ each represents aliphatic, aromatic, heterocyclic, arylamino, alkylamino groups. Further, $R_2$ represents ether, substituted thio, substituted amido, carbamoyl, cyano, acyl, sulfamoyl, sulfonyl, sulfinyl and oxycarbonyl groups, $X_1$, $X_2$ and $X_3$ each represents a hydrogen atom or a group capable of leaving upon a coupling reaction with an oxidized aromatic primary amine. In the general formula (II), Za, Zb and Zc each represents methine, substituted methine, =N— or —NH—, at least one of the Za-Zc bond and the Zb-Zc bond is a double bond and the other is a single bond. When the Zb-Zc bond is a carbon-carbon double bond, the Zb-Zc bond is included as a part of the aromatic ring. When $R_2$ or $X_2$ forms a dimer or a higher polymer, or Za, Zb or Zc is substituted methine, the substituted methine is included as at least a part of a dimer or a higher polymer.

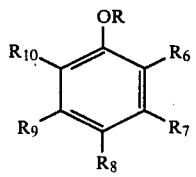

(A)

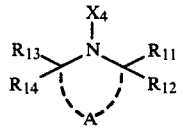

(B)

wherein R represents a hydrogen atom, an alkyl group, an alkenyl group, an aryl group or a heterocyclic group; $R_6$, $R_7$, $R_8$, $R_9$ and $R_{10}$ may be the same or different and each represents a hydrogen atom, an alkyl group, an alkenyl group, an aryl group, an alkoxycarbonyl group, an aryloxycarbonyl group, an acyl group, a hydroxyl group, an alkylamino group, an acylamino group, an imino group or a halogen atom; $R_{11}$, $R_{12}$, $R_{13}$ and $R_{14}$ may be the same or different and each represents a hydrogen atom or an alkyl group; $X_4$ represents a hydrogen atom, an alkyl group, an alkenyl group, an alkynyl group, an acyl group, a sulfonyl group, a sulfinyl group, an oxyradical group or a hydroxyl group; and A represents a non-metallic atom group necessary to form a 5-, 6- or 7-membered ring.

DETAILED DESCRIPTION OF THE INVENTION

The present invention will hereinafter be explained in detail.

In the general formula (I) representing a yellow coupler which is used in the present invention, $R_1$ represents a substituent, such as an aromatic group, an alkoxy group and a heterocyclic group, and $X_1$ represents a hydrogen atom, a halogen atom, a carboxyl group, or a group linked to a carbon atom at the coupling position through an oxygen atom, a nitrogen atom or a sulfur atom and capable of leaving upon coupling, and $X_1$ may be a divalent group and may form a bis body.

Next, $X_1$ is described below in greater detail.

$X_1$ represents a hydrogen atom, a halogen atom (e.g., a chlorine atom, a bromine atom and an iodine atom), a carboxyl group or a group linked through an oxygen atom (e.g., an acetoxy group, a propanoyloxy group, a benzoyloxy group, a 2,4-dichlorobenzoyloxy group, an ethoxyoxazoyloxy group, a pyruviloxy group, a cinnamoyloxy group, a phenoxy group, a 4-cyanophenoxy group, a 4-methanesulfonamidophenoxy group, a 4-methanesulfonylphenoxy group, an α-naphthoxy group, a 3-pentadecylphenoxy group, a benzyloxycarbonyloxy group, an ethoxy group, a 2-cyanoethoxy group, a benzyloxy group, a 2-phenethyloxy group, a 2-phenoxyethoxy group, a 5-phenyltetrazolyloxy group and a 2-benzothiazolyloxy group), a group linked through a nitrogen atom (e.g., a benzenesulfonamido group, an N-ethyltoluenesulfonamido group, a heptafluorobutanamido group, a 2,3,4,5,6-pentafluorobenzamido group, an octanesulfonamido group, a p-cyanophenylureido group, an N,N-diethylsulfamoylamino group, a 1-piperidyl group, a 5,5-dimethyl-2,4-dioxo-3-oxazolidinyl group, a 1-benzylethoxy-3-hydantoinyl group, a 2N-1,1-dioxo-3(2H)-oxo-1,2-benzoisothiazolyl group, a 2-oxo-1,2-dihydro-1-pyridinyl group, an imidazolyl group, a pyrazolyl group, a 3,5-diethyl-1,2,4-triazole-1-yl group, a 5- or 6-bromobenzotriazole-1-yl group, a 5-methyl-1,2,3,4-triazole-1-yl group, a benzimidazolyl group, a 3-benzyl-1-hydantoinyl group, a 1-benzyl-5-hexadecyloxy-3-hydantoinyl group and a 5-methyl-1-tetrazolyl group), an arylazo group (e.g., a 4-methoxyphenylazo group, a 4-pivaloylaminophenylazo group, a 2-naphthylazo group and a 3-methyl-4-hydroxyphenylazo group), or a group linked through a sulfur atom (e.g., a phenylthio group, a 2-carboxyphenylthio group, a 2-methoxy-5-tert-octylphenylthio group, a 4-methanesulfonylphenylthio group, a 4-octanesulfonamidophenylthio group, a 2-butoxyphenylthio group, a 2-(2-hexanesulfonylethyl)-5-tert-octylphenylthio group, a benzylthio group, a 2-cyanoethylthio group, a 1-ethoxycarbonyltridecylthio group, a 5-phenyl-2,3,4,5-tetrazoylthio group, a 2-benzothiazolylthio group, a 2-dodecylthio-5-thiophenylthio group, and a 2-phenyl-3-dodecyl-1,2,4-triazole-5-thio group).

In the case that $X_1$ forms a bis body as a divalent group, $X_1$ represents a divalent group as derived from the above listed monovalent groups.

When $R_1$ represents an aromatic group (particularly a phenyl group), the aromatic group may be substituted. The aromatic group, e.g., a phenyl group, may be substituted with an alkyl group having not more than 32 carbon atoms, an alkenyl group, an alkoxy group, an alkoxycarbonyl group, an alkoxycarbonylamino group, an aliphatic amido group, an alkylsulfamoyl group, an alkylsulfonamido group, an alkylureido group, an alkyl-substituted succinimido group and the like. In this case, the alkyl group may contain an aromatic group such as phenylene in the chain thereof. The phenyl group may be further substituted with an arylxoy group, an aryloxycarbonyl group, an arylcarbamoyl group, an arylamido group, an arylsulfamoyl group, an arylsulfonamido group, an arylureido group and the like. The aryl group portion of these substituents may be further substituted with at least one alkyl group the total number of carbon atoms of which is 1 to 22.

The phenyl group represented by $R_1$ may be further substituted with an amino group including those substituted with a lower alkyl group having 1 to 6 carbon atoms, a hydroxyl group, a carboxyl group, a sulfo group, a nitro group, a cyano group, a thiocyano group or a halogen atom.

$R_1$ also represents a substituent resulting from condensation of a phenyl group and other ring, such as a naphthyl group, a quinolyl group, an isoquinolyl group, a cromanyl group, a cumaranyl group and a tetrahydronaphthyl group. These substituents may be further substituted.

In the case where $R_1$ represents a heterocyclic group, the heterocyclic group is linked through a carbon atom constituting the ring to a carbon atom of the carbonyl group of the acyl group or a nitrogen atom of the amido group in α-acylacetamide. Examples of such heterocyclic rings are thiophene, furan, pyran, pyrrole, pyrazole, pyridine, pyrimidine, pyridamine, indolizine, imidazole, thiazole, oxazole, triazine, thiadiazine and oxazine. These groups may further have a substituent on the ring thereof.

Of the above couplers, those in which $R_1$ represents a substituted or unsubstituted aryl group are preferred.

In any portion of $R_1$ and $X_1$, a polymer of more than a bis body may be formed. In any portion of these groups, a polymer of a monomer having an ethylenically unsaturated group in any desired portion of the group or a copolymer of the monomer and a monomer not forming color may be included.
Particularly preferred examples of yellow couplers which can be used in the present invention in combination are shown below.
(Y-1)
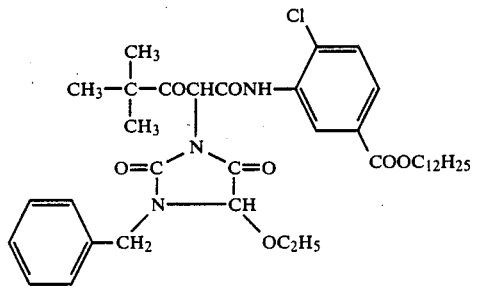
(Y-2)
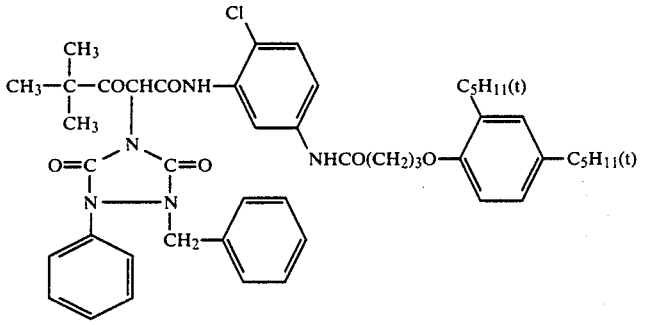
(Y-3)
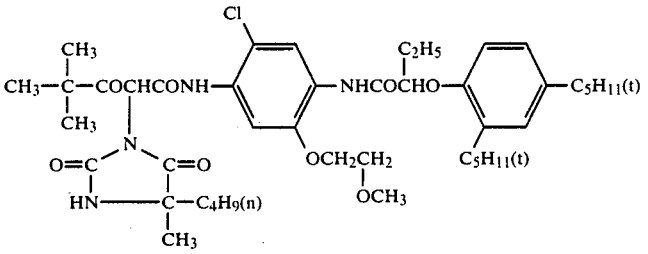
(Y-4)
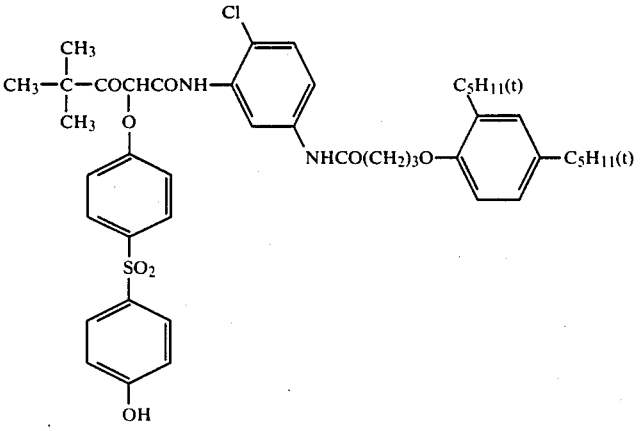

-continued
(Y-5)
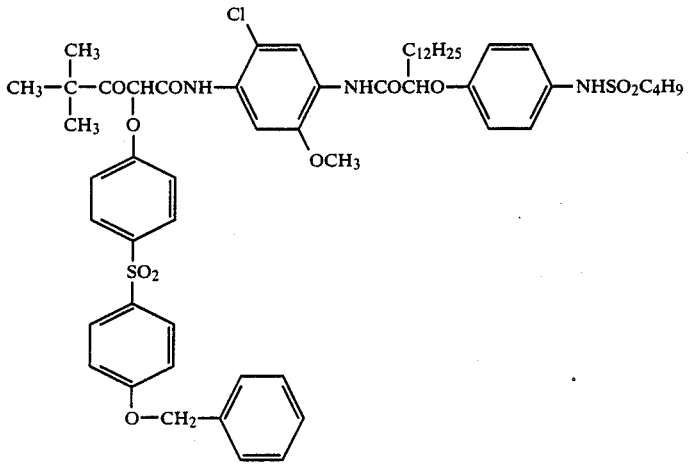
(Y-6)
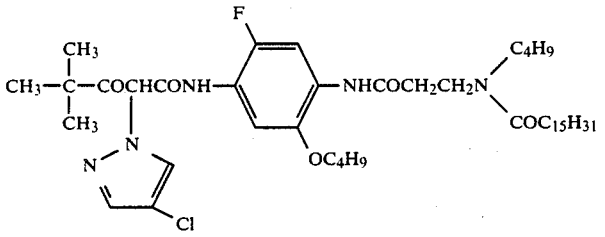
(Y-7)
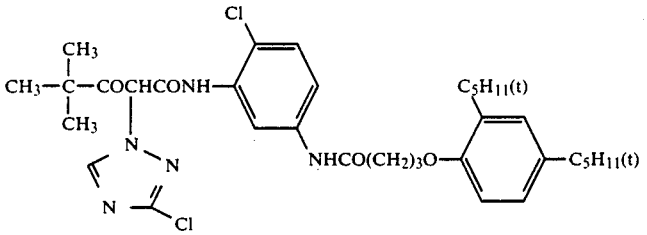
(Y-8)
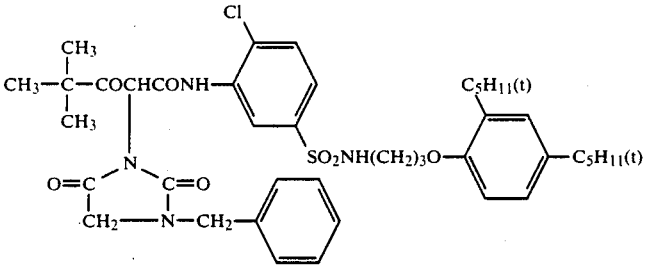
(Y-9)
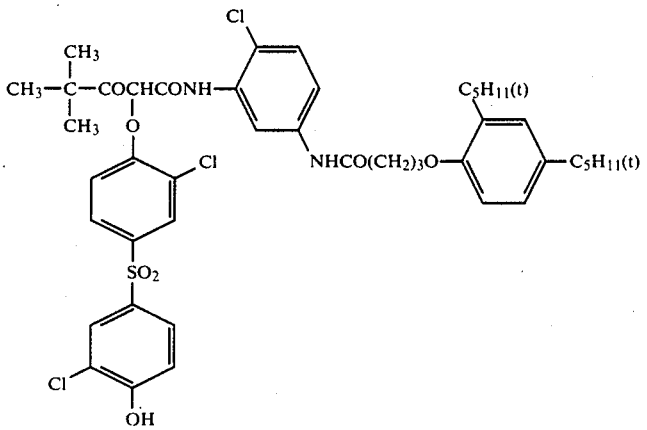

-continued (Y-10)

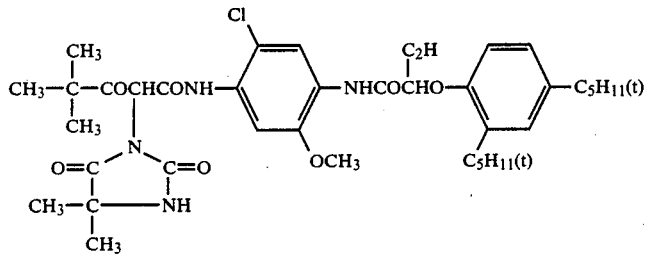

(Y-11)

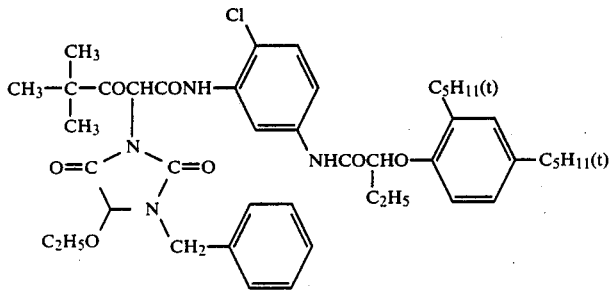

(Y-12)

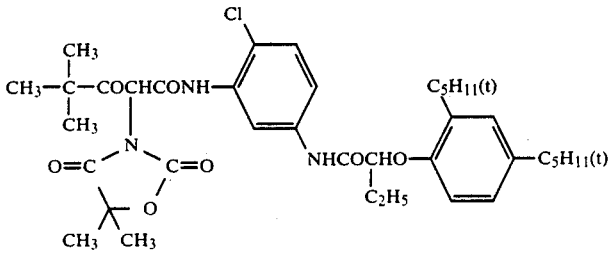

(Y-13)

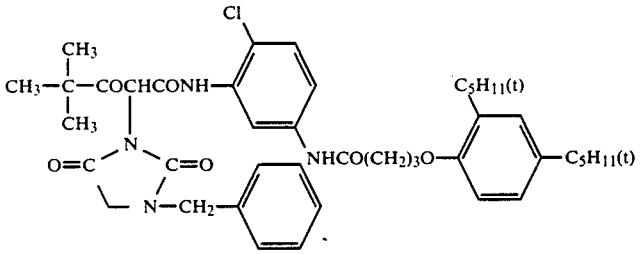

The compounds of the general formula (II) which are used as magenta couplers in the present invention will hereinafter be explained in detail.

In the general formula (II), the dimer is a compound having two groups and the polymer is a compound containing at least two groups represented by the general formula (II) in the molecule, and includes a bis body and a polymer coupler. This polymer coupler may be a homopolymer of a monomer containing a portion represented by the general formula (II) (preferably containing a vinyl group; hereinafter referred to as a "vinyl monomer") or may form a copolymer with a non-color-forming ethylenical monomer not undergoing a coupling reaction with an oxidized aromatic primary amine developer.

Preferred among the pyrazole-based magenta couplers represented by the general formula (II) are those represented by the following general formulae (II-a), (II-b), (II-c), (II-d), (II-e), (II-f) and (II-g).

(II-a)

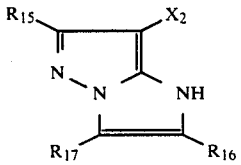

(II-b)

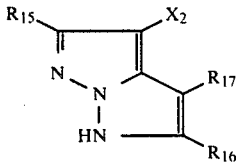

-continued

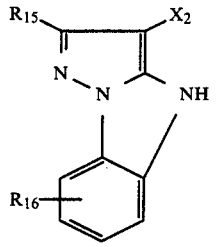

(II-c)

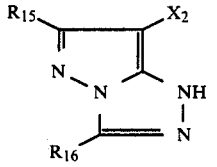

(II-d)

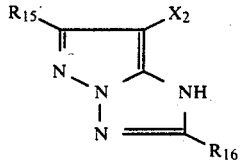

(II-e)

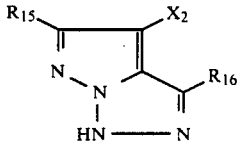

(II-f)

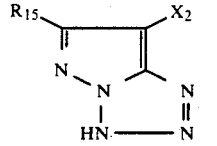

(II-g)

Of the couplers represented by the general formulae (II-a) to (II-g), the couplers represented by the general formulae (II-a), (II-d) and (II-e) are preferred, and the couplers represented by the general formulae (II-d) and (II-e) are more preferred.

In the general formulae (II-a) to (II-g), $R_{15}$, $R_{16}$ and $R_{17}$ may be the same or different and each represents a hydrogen atom, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group or an aryloxycarbonyl group.

$X_2$ represents a hydrogen atom, a halogen atom, a carboxyl group, or a group linked to a carbon atom at the coupling position through an oxygen atom, a nitrogen atom or a sulfur atom and capable of leaving upon coupling.

$R_{15}$, $R_{16}$, $R_{17}$ or $X_2$ may become a divalent group to thereby form a bis body.

The coupler radicals represented by the general formulae (II-a) to (II-g) may be in the form of a polymer coupler present in the main chain or side chain of the polymer. Particularly preferred are polymers derived from vinyl monomers having a portion represented by the general formula. In this case, $R_{15}$, $R_{16}$, $R_{17}$ or $X_2$ represents a vinyl group or a connecting group.

More specifically, $R_{15}$, $R_{16}$ and $R_{17}$ each represents a hydrogen atom, a halogen atom (e.g., a chlorine atom and a bromine atom), an alkyl group (e.g., a methyl group, a propyl group, a tert-butyl group, a trifluoromethyl group, a tridecyl group, a 3-(2,4-di-tert-amylphenoxy)propyl group, a 2-dodecyloxyethyl group, a 3-phenoxypropyl group, a 2-hexylsulfonylethyl group, a cyclopentyl group, and a benzyl group), an alkenyl group (e.g., an allyl group and an octadecyl group), an aryl group (e.g., a phenyl group, a 4-tert-butylphenyl group, a 2,4-di-tert-amylphenyl group and a 4-tetradecanamidophenyl group), a heterocyclic group (e.g., a 2-furyl group, a 2-thienyl group, a 2-pyrimidyl group and a 2-benzothiazolyl group), a cyano group, an alkoxy group (e.g., a methoxy group, an ethoxy group, a 2-methoxyethoxy group, a 2-dodecyloxyethoxy group and a 2-methanesulfonylethoxy group), an aryloxy group (e.g., a phenoxy group, a 2-methylphenoxy group and a 4-tert-butylphenoxy group), a heterocyclic oxy group (e.g., a 2-benzimidazolyloxy group), an acyloxy group (e.g., an acetoxy group and a hexadecanoyloxy group), a carbamoyloxy group (e.g., an N-phenylcarbamoyloxy group and an N-ethylcarbamoyloxy group), a silyloxy group (e.g., a trimethylsilyloxy group), a sulfonyloxy group (e.g., a dodecylsulfonyloxy group), an acylamino group (e.g., an acetamido group, a benzamido group, a tetradecanamido group, an α-(2,4-di-tert-amylphenoxy)butyramido group, a γ-(3-tert-butyl-4-hydroxyphenoxy)butyramido group and an α-[4-(4-hydroxyphenylsulfonyl)phenoxy]decanamido group), an anilino group (e.g., a phenylamino group, a 2-chloroanilino group, a 2-chloro-5-tetradecanamidoanilino group, a 2-chloro-5-dodecyloxycarbonylanilino group, an N-acetylanilino group and a 2-chloro-5-[α-(3-tert-butyl-4-hydroxyphenoxy)-dodecanamido]anilino group), a ureido group (e.g., a phenylureido group, a methylureido group and an N,N-dibutylureido group), an imido group (e.g., an N-succinimido group, a 3-benzylhydantoinyl group and a 4-(2-ethylhexanoylamino)phthalimido group), a sulfamoylamino group (e.g., an N,N-dipropylsulfamoylamino group and an N-methyl-N-decylsulfamoylamino group), an alkylthio group (e.g., a methylthio group, an octylthio group, a tetradecylthio group, a 2-phenoxyethylthio group, a 3-phenoxypropylthio group and a 3-(4-tert-butylphenoxy)propylthio group), an arylthio group (e.g., a phenylthio group, a 2-butoxy-5-tert-octylphenylthio group, a 3-pentadecylphenylthio group, a 2-carboxyphenylthio group and a 4-tetradecanamidophenylthio group), a heterocyclic thio group (e.g., a 2-benzothiazolylthio group), an alkoxycarbonylamino group (e.g., a methoxycarbonylamino group and a tetradecyloxycarbonylamino group), an aryloxycarbonylamino group (e.g., a phenoxycarbonylamino group and a 2,4-di-tert-butylphenoxycarbonylamino group), a sulfonamido group (e.g., a methanesulfonamido group, a hexadecanesulfonamido group, a benzenesulfonamido group, a p-toluenesulfonamido group, an octadecanesulfonamido group and a 2-methyloxy-5-tert-butylbenzenesulfonamido group), a carbamoyl group (e.g., an N-ethylcarbamoyl group, an N,N-dibutylcarbamoyl group, an N-(2-dodecyloxyethyl)carbamoyl group, an N-methyl- N-dodecylcarbamoyl group and an N-[3-(2,4-di-tert-amylphenoxy)propyl]carbamoyl group), an acyl group (e.g., an acetyl group, a (2,4-di-tert-amylphenoxy)acetyl group and a benzoyl group), a sulfamoyl group (e.g., an N-ethylsulfamoyl group, an N,N-dipropylsulfamoyl group, an N-(2-dodecyloxyethyl)sulfamoyl group, an N-ethyl-N-dodecylsulfamoyl group and an N,N-diethylsulfamoyl group), a sulfonyl group (e.g., a methanesulfonyl group, an octanesulfonyl group, a benzenesulfonyl group and a toluenesulfonyl group), a sulfinyl group (e.g., an octanesulfinyl group, a dodecylsulfinyl group and a phenylsulfinyl group), an alkoxycarbonyl group (e.g., a methoxycarbonyl group, a butyloxycarbonyl group, a dodecylcarbonyl group and an octadecylcarbonyl group), or an aryloxycarbonyl group (e.g., a phenyloxycarbonyl group and a 3-pentadecyloxycarbonyl group).

$X_2$ is the same as $X_1$ defined in the general formula (I).

In the couplers of the general formulae (II-a) and (II-b), $R_{16}$ and $R_{17}$ may combine together to form a 5- to 7-membered ring.

In the case where $R_{15}$, $R_{16}$, $R_{17}$ or $X_2$ forms a bis body as a divalent group, it is preferred that $R_{15}$, $R_{16}$ and $R_{17}$ represent a substituted or unsubstituted alkylene group (e.g., a methylene group, an ethylene group, a 1,10-decylene group and $—CH_2CH_2—O—CH_2CH_2—$), a substituted or unsubstituted phenyl group (e.g., a 1,4-phenylene group, a 1,3-phenylene group,

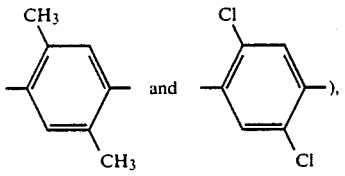

a group $—NHCO—R_{18}—CONH—$ (wherein $R_{18}$ represents a substituted or unsubstituted alkylene group or phenylene group, e.g., $—NHCOCH_2CH_2CONH—$,

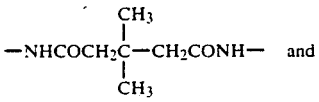

and

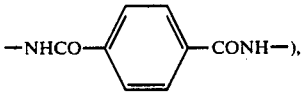

or a group $—S—R_{19}—S—$ (wherein $R_{19}$ represents a substituted or unsubstituted alkylene group, e.g., $—S—CH_2CH_2—S—$ and

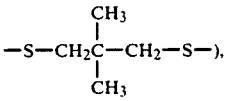

and $X_2$ represents a divalent group derived from the above monovalent group.

The connecting group represented by $R_{15}$, $R_{16}$, $R_{17}$ or $X_2$ in the case where those represented by the general formulae (II-a), (II-b), (II-c), (II-d), (II-e), (II-f) and (II-g) are included in the vinyl monomers includes groups resulting from combination of those selected from an alkylene group (a substituted or unsubstituted alkylene group, e.g., a methylene group, an ethylene group, a 1,10-decylene group and $—CH_2CH_2OCH_2CH_2—$), a phenylene group (a substituted or unsubstituted phenylene group, e.g., a 1,4-phenylene group, a 1,3-phenylene group,

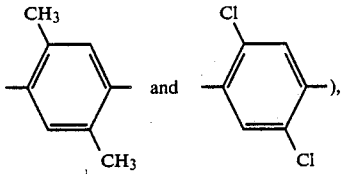

—NHCO—, —CONH—, —O—, —OCO— and an aralkylene group (e.g.,

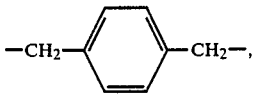

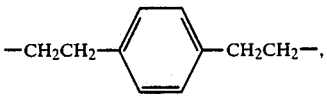

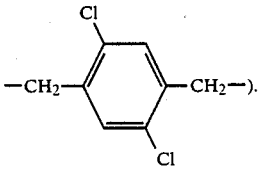

Preferred examples of the connecting group are shown below.

—NHCO—, $—CH_2CH_2—$,

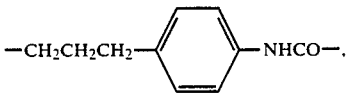

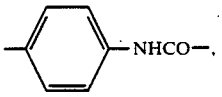

$—CH_2CH_2NHCO—$, $—CH_2CH_2—O—\underset{\underset{O}{\|}}{C}—$, $—CONH—CH_2CH_2NHCO—$, $—CH_2CH_2O—CH_2CH_2—NHCO—$,

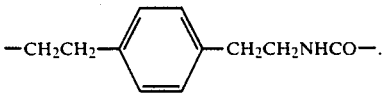

The vinyl group may have a substituent as well as the groups represented by the general formulae (II-a), (II-b), (II-c), (II-d), (II-e), (II-f) and (II-g). Preferred substituents are a hydrogen atom, a chlorine atom and a lower alkyl group having 1 to 4 carbon atoms.

Monomers containing those groups represented by the general formulae (II-a), (II-b), (II-c), (II-d), (II-e), (II-f) and (II-g) may form copolymers with non-color-forming ethylenical monomers not undergoing a coupling reaction with an oxidized product of an aromatic primary amine developer.

Such non-color-forming ethylenical monomers not undergoing a coupling reaction with an oxidized product of an aromatic primary amine developer include acrylic acid, α-chloroacrylic acid, α-alkylacrylic acid (e.g., methacrylic acid), and esters or amides derived from these acrylic acids, such as acrylamide, n-butylacrylamide, tert-butylacrylamide, diacetoneacrylamide, methacrylamide, methyl acrylate, ethyl acrylate, n-propyl acrylate, n-butyl acrylate, tert-butyl acrylate, isobutyl acrylate, 2-ethylhexyl acrylate, n-octyl acrylate, lauryl acrylate, methyl methacrylate, ethyl methacrylate, n-butyl methacrylate and β-hydroxy methacrylate, methylenebisacrylamide, vinyl esters (e.g., vinyl acetate, vinyl propionate and vinyl laurate), acrylonitrile, methacrylonitrile, aromatic vinyl compounds (e.g., styrene and its derivatives, vinyltoluene, divinylbenzene, vinylacetophenone and sulfostyrene), itaconic acid, citraconic acid, crotonic acid, vinylidene chloride, vinyl alkyl ethers (e.g., vinyl ethyl ether), maleic acid, maleic anhydride, maleic acid esters, N-vinyl-2-pyrrolidone, N-vinylpyridine and 2- and 4-vinylpyridine. These non-color-forming ethylenically unsaturated monomers can be used as mixtures comprising two or more thereof. For example, mixtures of n-butyl acrylate and methyl acrylate, of styrene and methacrylic acid, of methacrylic acid and acrylamide, and of methyl acrylate and diacetone acrylamide can be used.

As is well known in the field of polymer color couplers, the non-color-forming ethylenically unsaturated monomer to be copolymerized with a solid water-insoluble monomer coupler can be chosen so that the physical and/or chemical properties of the copolymer formed, such as solubility, compatibility with a binder, e.g., gelatin of a photographic colloid composition, flexibility and thermal stability are improved.

The polymer coupler which is used in the present invention may be either water-soluble or water-insoluble. Particularly preferred is a polymer coupler latex.

Of the compounds represented by the general formulae (II-d) and (II-e) which are particularly preferred among the pyrazoloazole-based magenta couplers of the present invention, those compounds in which at least one of $R_{15}$ and $R_{16}$ has a group linked to a pyrazoloazole ring through a secondary or tertiary carbon atom, and in which at least one of $R_{15}$ and $R_{16}$ contains a substituent —$NHSO_2$— are particularly preferred. Of these compounds, the compounds represented by the general formula (II-e) and satisfying the above requirements are particularly preferred.

The branched alkyl group which contains at least one carbon atom bonded with more than two carbon atoms will hereinafter be explained in detail.

The branched alkyl group includes an isopropyl group, a tert-hexyl group, a cyclohexyl group, an adamantyl group, a 1-ethoxyisopropyl group, a 1-phenoxy-1,1-dimethylethyl group, an α,α-dimethylbenzyl group, an α,α-dimethylphenylethyl group, an α-ethylbenzyl group, a 1-ethyl-1-[4-(2-butoxy-5-tert-octylbenzylsulfonamido)phenyl]methyl group, a 1-methyl-2-[4-(4-dodecyloxybenzenesulfonamido)phenyl]ethyl group, a 1-methyl-2-(2-octyloxy-5-tert-octylbenzylsulfonamido]ethyl group, a 1,1-dimethyl-2-(2-octyloxy-5-tert-octylbenzenesulfonamido ethyl group, a 1-methyl-2-[2-octyloxy-5-(2-octyloxy-5-tert-octylbenzenesulfonamido]benzenesulfonamido ethyl group, a 1-ethyl-2-(2-dodecyloxy-5-tert-octylbenzenesulfonamido ethyl group, and a 1-(2-hydroxyethyl)-2-{α-[3-(2-octyloxy-5-tert-octylbenzenesulfonamido)phenoxy]-dodecanamido}ethyl group.

Representative examples of the pyrazoloazole-based magenta couplers represented by the general formula (II) and methods of preparation thereof are described in Japanese Patent Application (OPI) Nos. 162,548/84, 171,956/84, 33552/85, 43659/85 (the term "OPI" as used herein refers to a "published unexamined Japanese patent application"), U.S. Pat. Nos. 3,061,432, 3,369,897 and 3,725,067.

Representative examples of such typical magenta couplers are shown below although the present invention is not limited thereto.

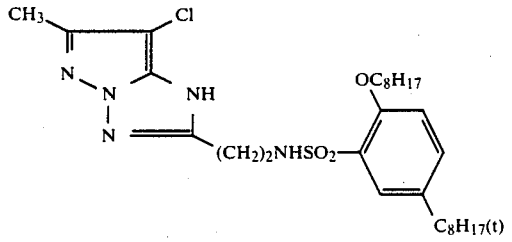

(M-1)

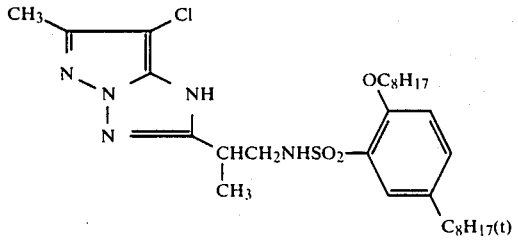

(M-2)

-continued
(M-3)
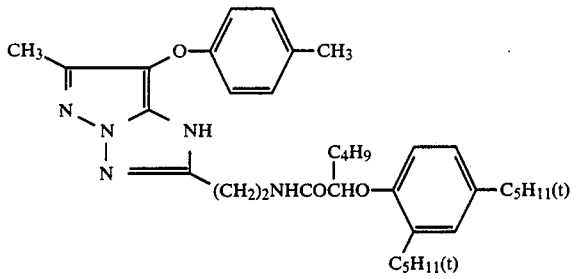
(M-4)
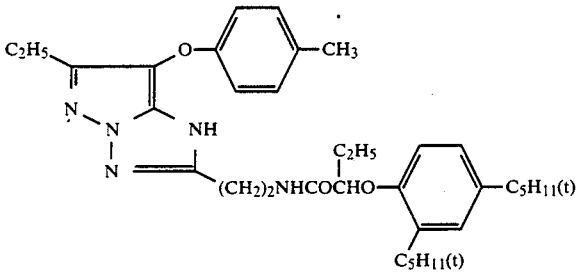
(M-5)
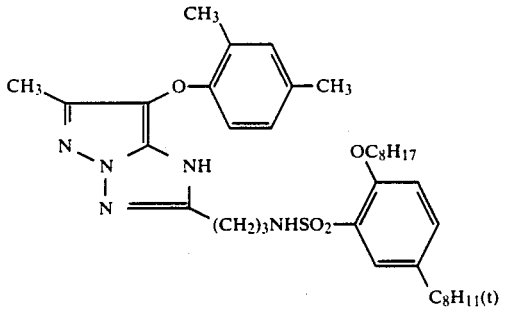
(M-6)
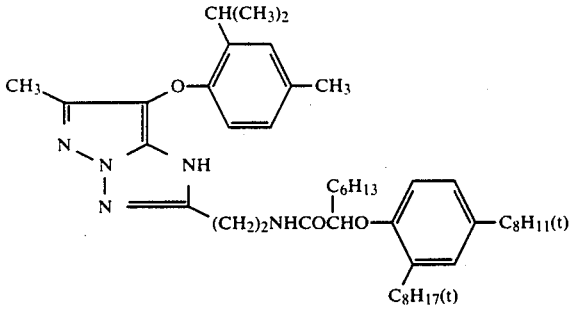
(M-7)
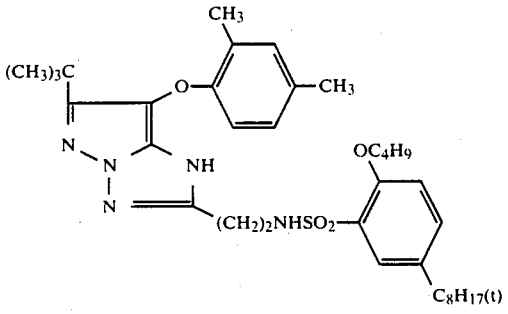

-continued
(M-8)
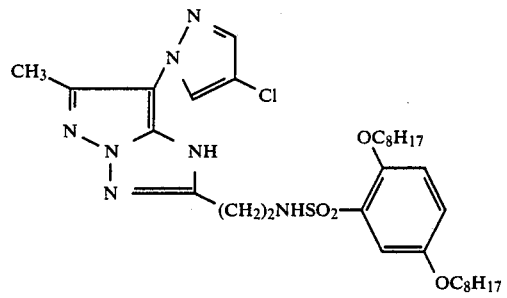
(M-9)
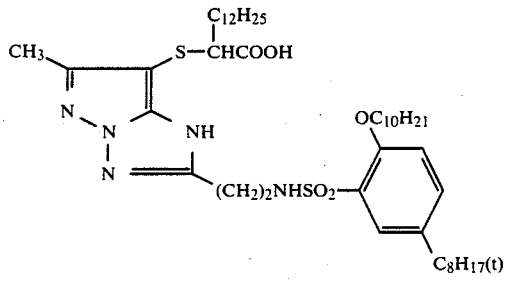
(M-10)
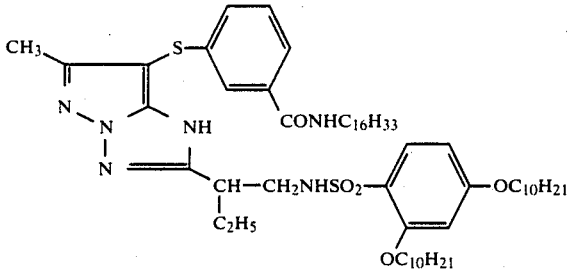
(M-11)
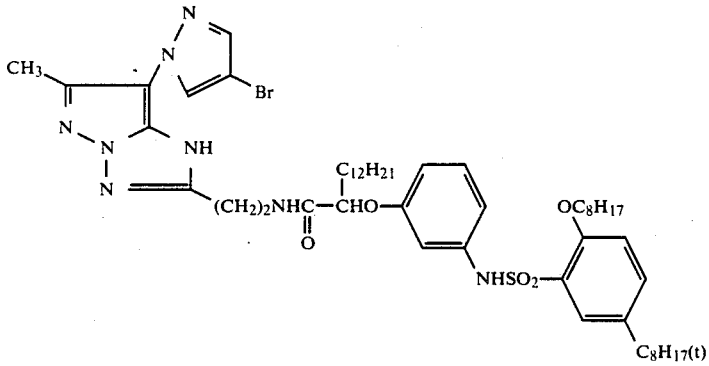
(M-12)
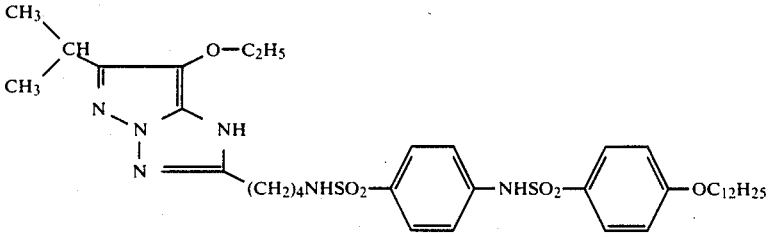

-continued
(M-13)
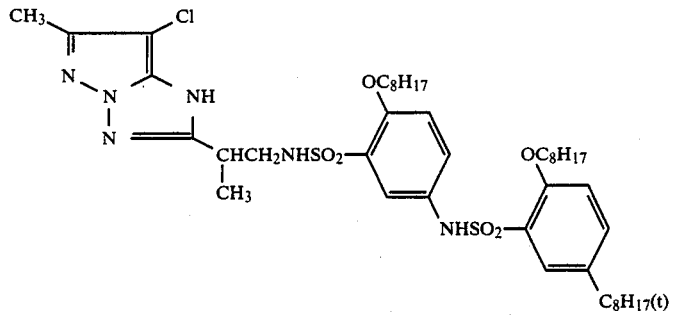
(M-14)
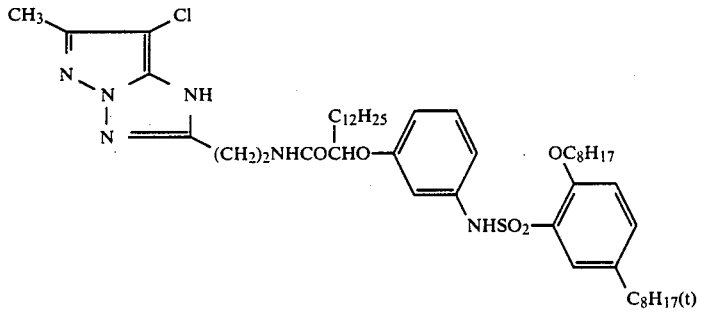
(M-15)
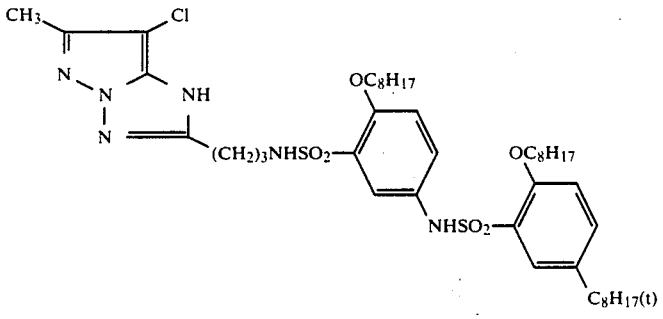
(M-16)
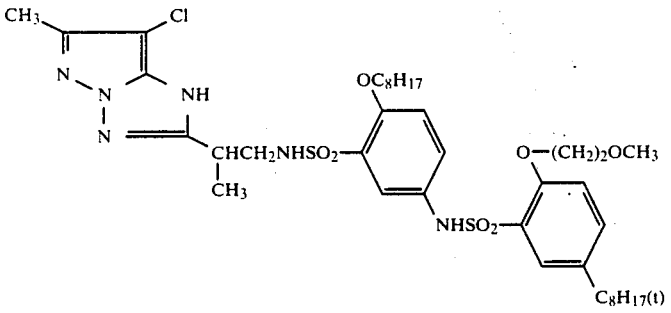
(M-17)
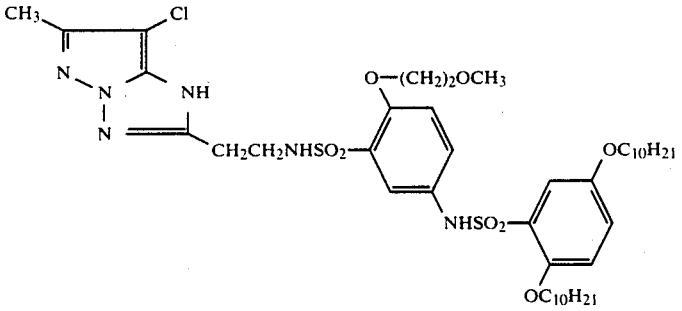

-continued
(M-18)
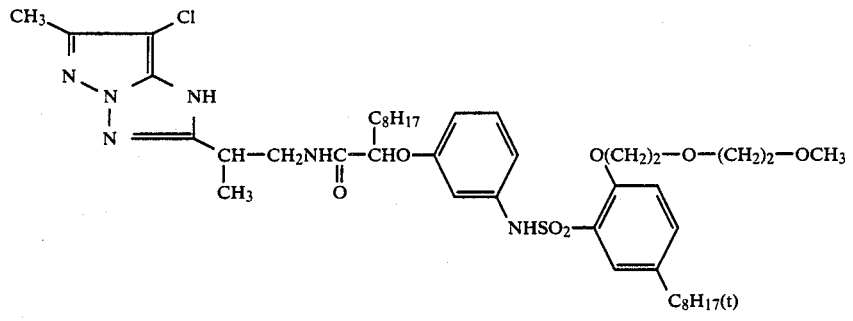
(M-19)
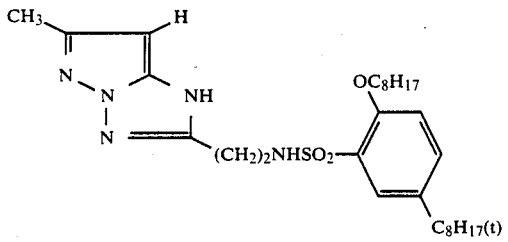
(M-20)
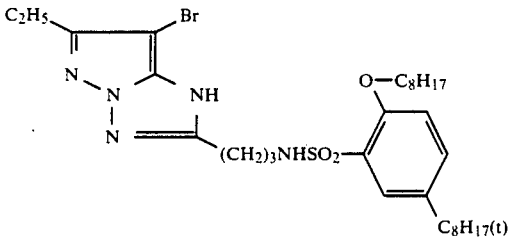
(M-21)
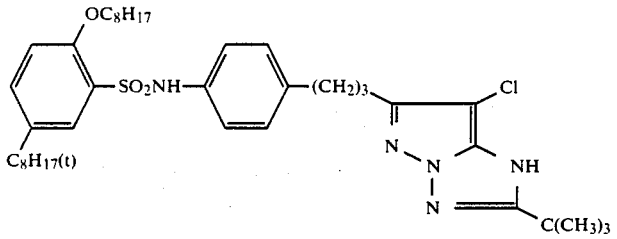
(M-22)
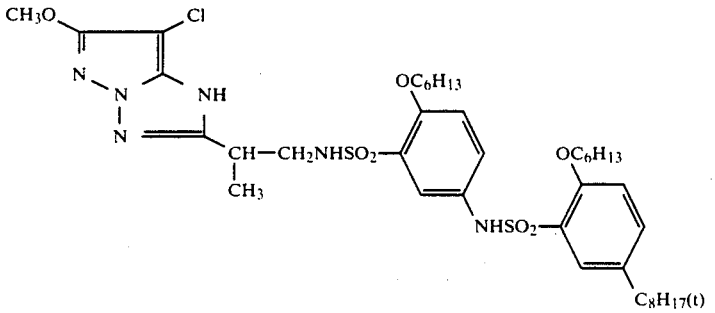

-continued
(M-23)
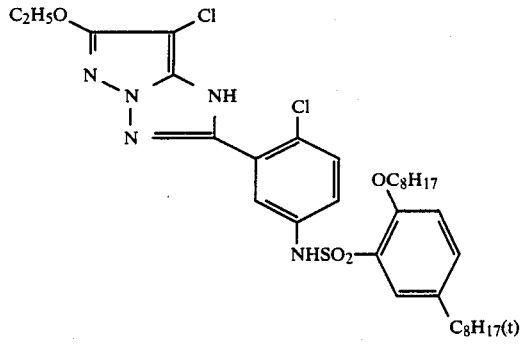
(M-24)
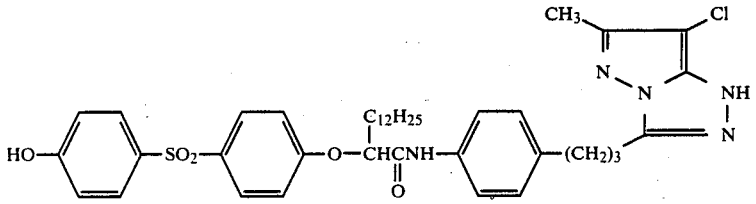
(M-25)
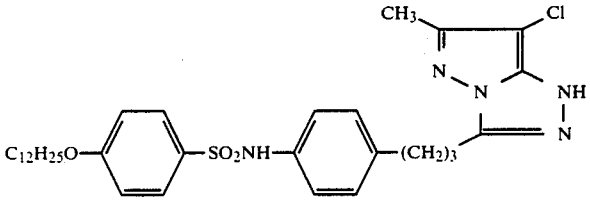
(M-26)
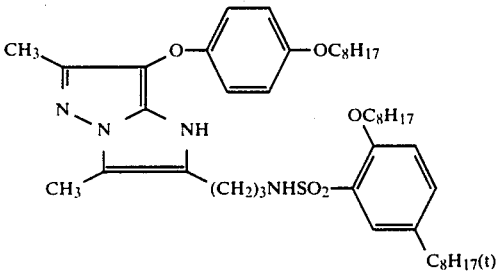
(M-27)
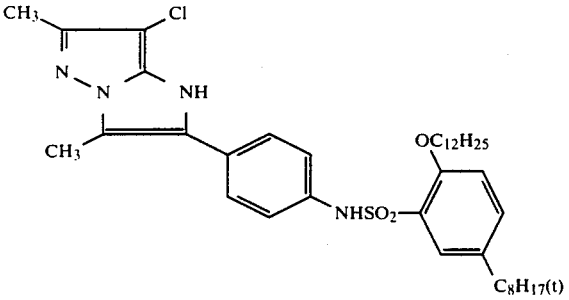
(M-28)
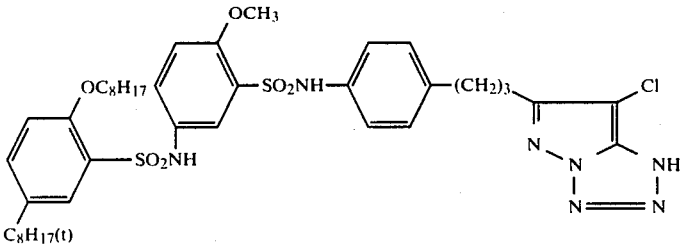

-continued
(M-29)
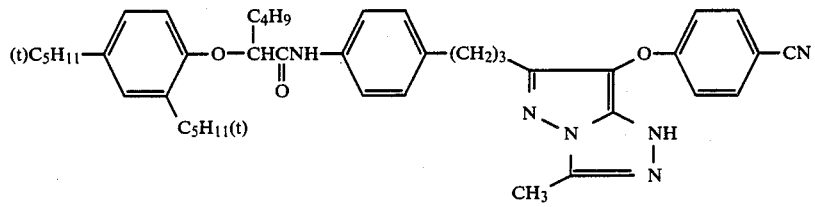
(M-30)
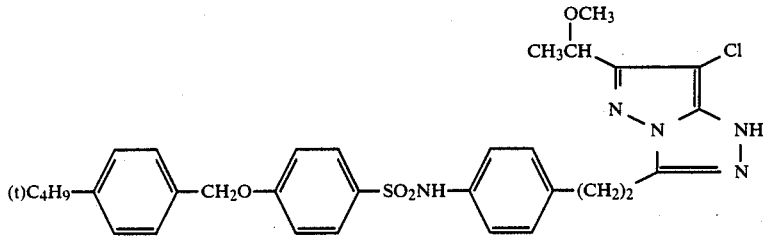
(M-31)
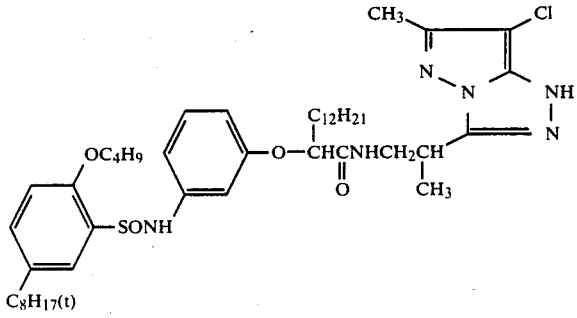
(M-32)
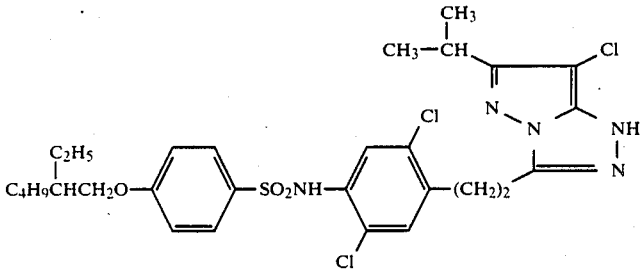
(M-33)
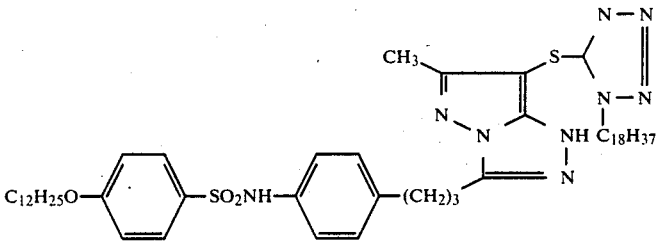
(M-34)
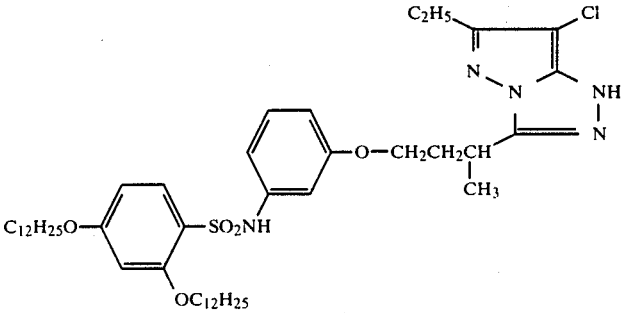

-continued
(M-35)
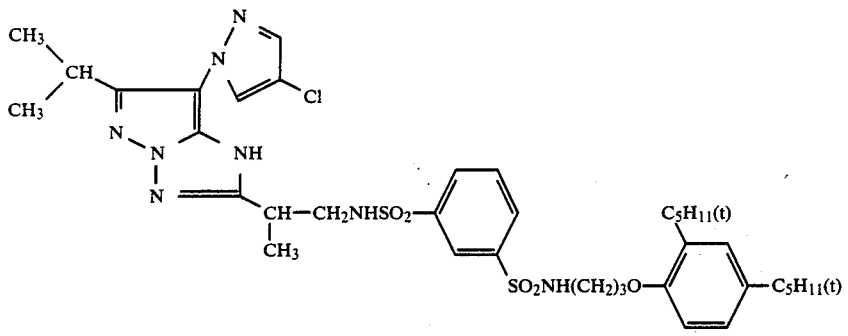
(M-36)
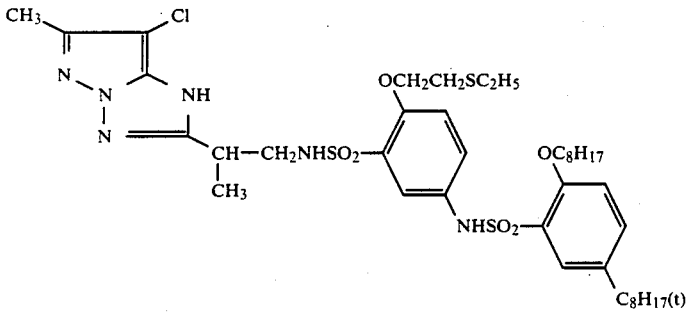
(M-37)
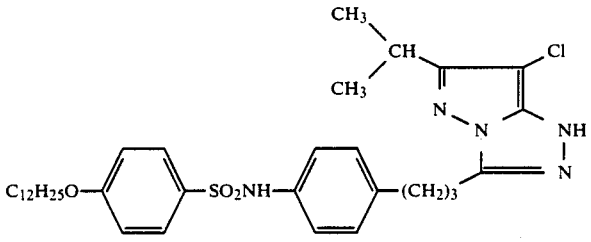
(M-38)
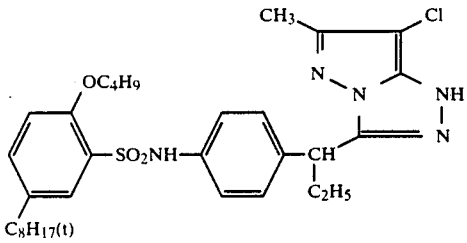
(M-39)
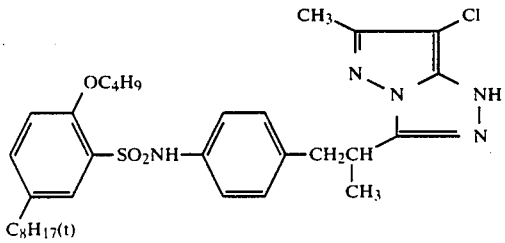

-continued (M-40)

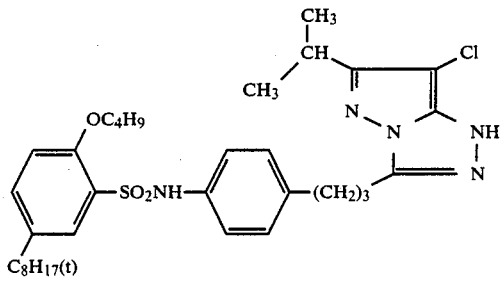

In the general formula (III) representing the cyan couplers which are used in the present invention, $R_3$ and $R_4$ each represents an aliphatic group having 1 to 31 carbon atoms (e.g., a methyl group, a butyl group, an octyl group, a tridecyl group, an isohexadecyl group and a cyclohexyl group), or an aryl group (e.g., a phenyl group, a naphthyl group, a 2-pyridyl group, a 2-thiazolyl group, a 2-imidazolyl group, a 2-furyl group and a 6-quinolyl group). These groups may be substituted with a group or groups selected from an alkyl group, an aryl group, a heterocyclic group, an alkoxy group (e.g., a methoxy group, a 2-methoxyethoxy group, a tetradecyloxy group), an aryloxy group (e.g., a 2,4-di-tert-amylphenoxy group, a 2-chlorophenoxy group, a 4-cyanophenoxy group and a 4-butanesulfonamidophenoxy group), an acyl group (e.g., an acetyl group and a benzoyl group), an ester group (e.g., an ethoxycarbonyl group, a 2,4-di-tert-amylphenoxycarbonyl group, an acetoxy group, a benzoyloxy group, a butoxysulfonyl group and a toluenesulfonyloxy group), an amido group (e.g., an acetylamino group, a butanesulfonamido group, a dodecylbenzenesulfonamido group and a dipropylsulfamoylamino group), a carbamoyl group (e.g., a dimethylcarbamoyl group and an ethylcarbamoyl group), a sulfamoyl group (e.g., a butylsulfamoyl group), an imido group (e.g., a succinimido group and a hydantoinyl group), a ureido group (e.g., a phenylureido group and a dimethylureido group), a sulfonyl group (e.g., a methanesulfonyl group, a carboxymethanesulfonyl group and a phenylsulfonyl group), an aliphatic or aromatic thio group (e.g., a butylthio group and a phenylthio group), a hydroxyl group, a cyano group, a carboxyl group, a nitro group, a sulfo group and a halogen atom. When they are substituted with two or more groups, the groups may be the same or different.

In the above general formula (III), $R_5$ represents a hydrogen atom, a halogen atom, an alkyl group, an aryl group, an acylamino group or a non-metallic atom group forming a 5- or 6-membered nitrogen-containing ring in combination with $R_4$.

Preferred examples of the cyan couplers represented by the general formula (III) are shown below.

In the general formula (III), $R_3$ is preferably an aryl group or a heterocyclic group, and more preferably an aryl group which is substituted with a halogen atom, an alkyl group, an alkoxyl group, an aryloxy group, an acylamino group, an acyl group, a carbamoyl group, a sulfonamido group, a sulfamoyl group, a sulfonyl group, a sulfamido group, an oxycarbonyl group or a cyano group.

In the case where in the general formula (III), $R_5$ and $R_4$ do not form a ring, $R_4$ is preferably a substituted or unsubstituted alkyl group, or an aryl group, and more preferably an aryloxy-substituted alkyl group, and $R_5$ is preferably a hydrogen atom.

$X_3$ is the same as $X_1$ in the general formula (I).

Representative examples of the cyan couplers which are used in the present invention are shown below.

(C-1)

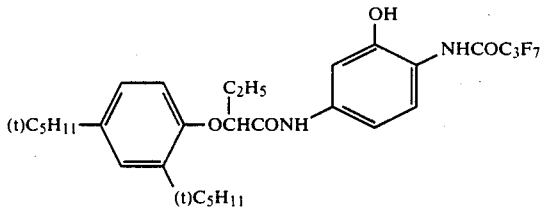

(C-2)

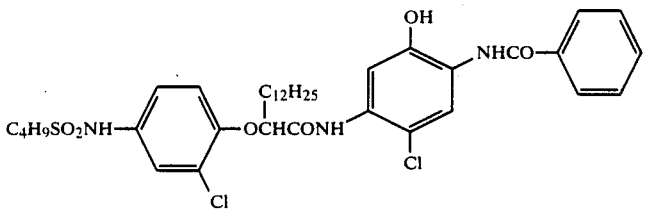

-continued
(C-3)
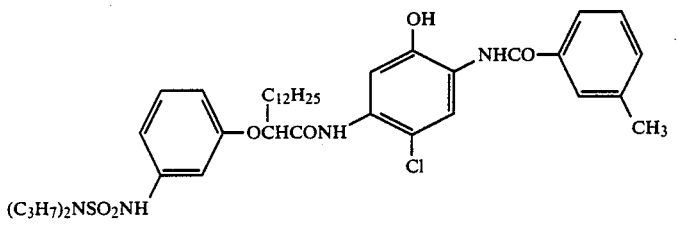
(C-4)
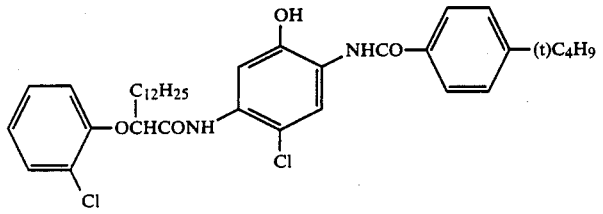
(C-5)
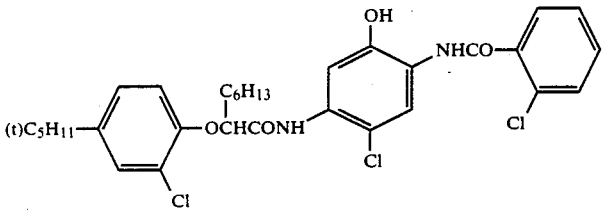
(C-6)
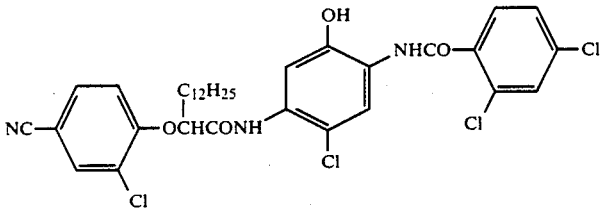
(C-7)
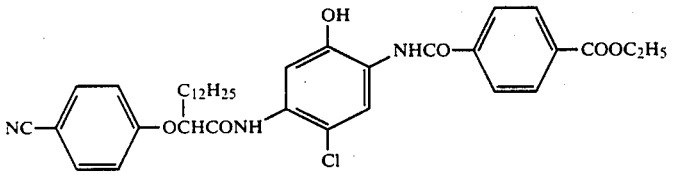
(C-8)
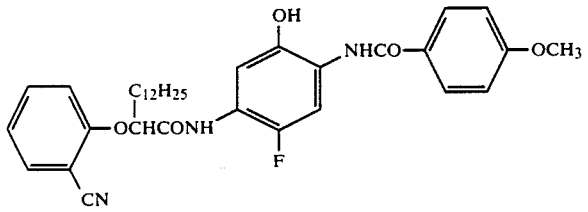
(C-9)
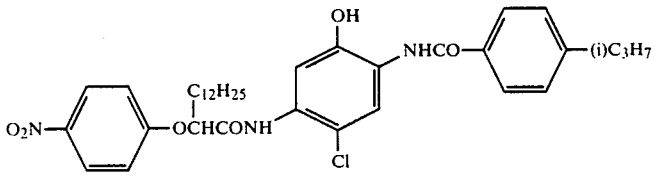

-continued
(C-10)
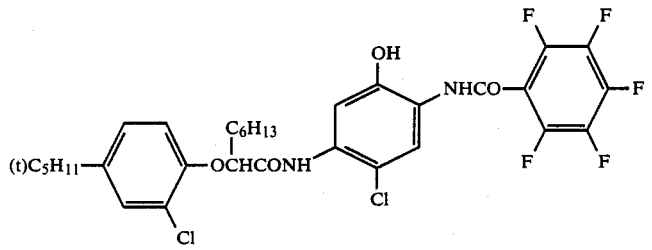
(C-11)
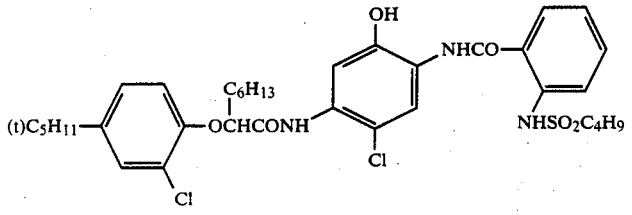
(C-12)
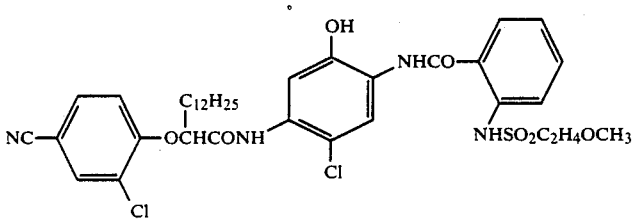
(C-13)
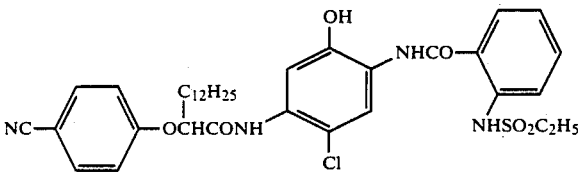
(C-14)
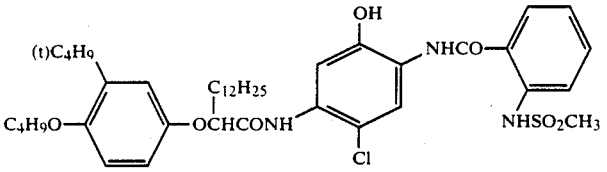
(C-15)
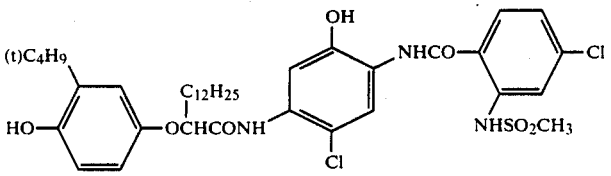
(C-16)
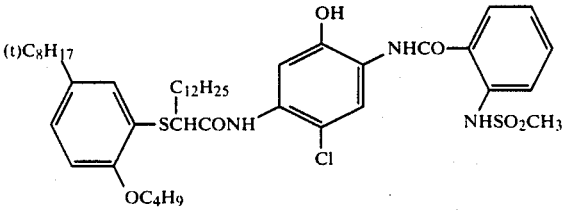

-continued
(C-17)
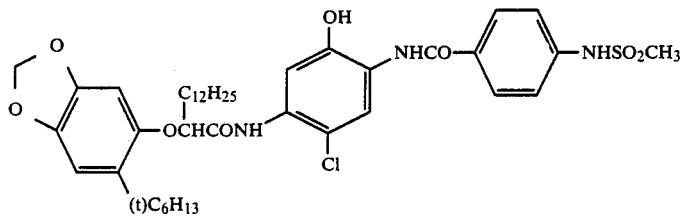
(C-18)
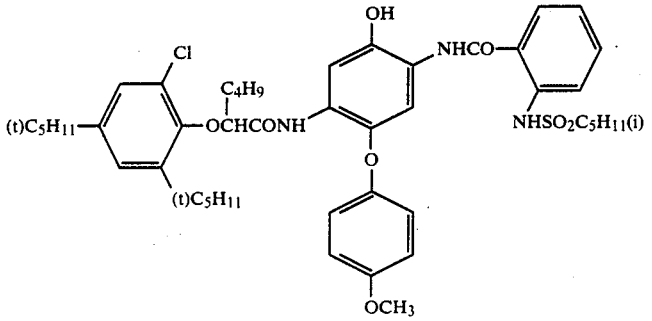
(C-19)
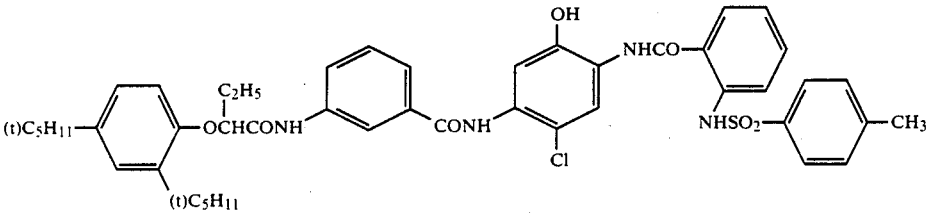
(C-20)
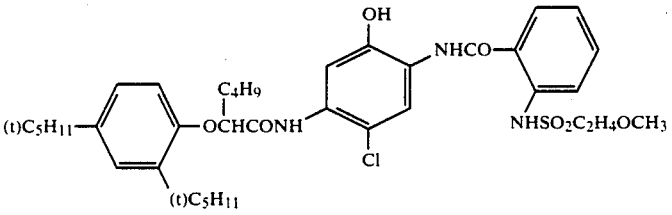
(C-21)
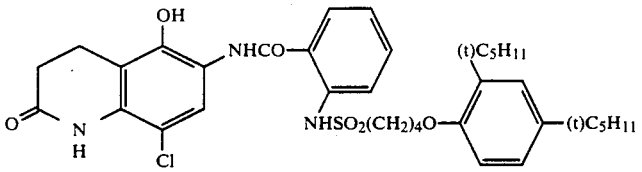
(C-22)
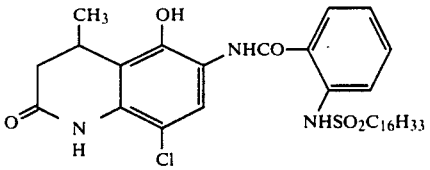
(C-23)
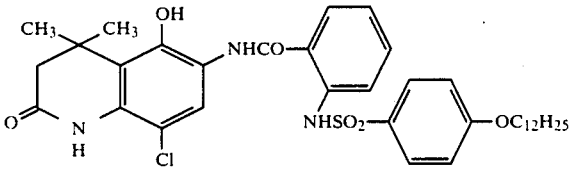

-continued
(C-24)
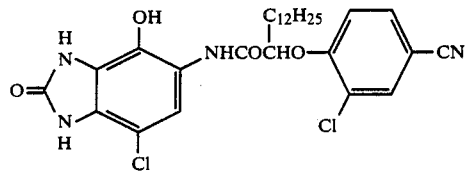
(C-25)
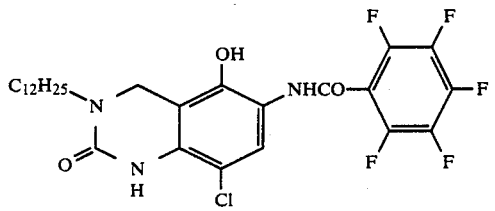
(C-26)
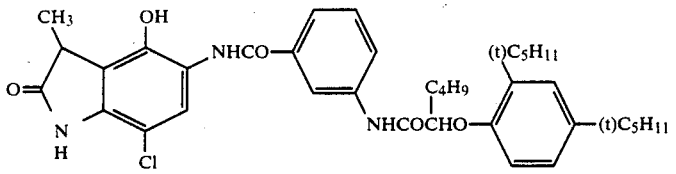
(C-27)
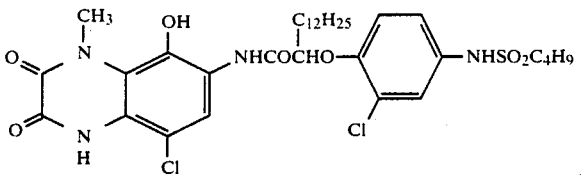
(C-28)
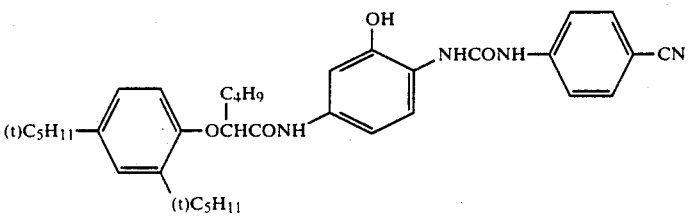
(C-29)
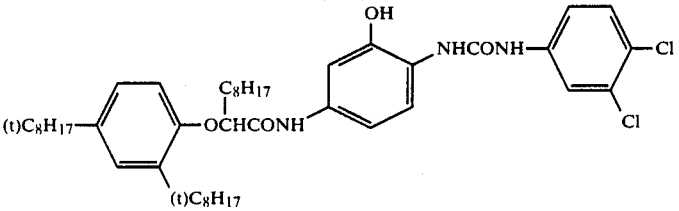
(C-30)
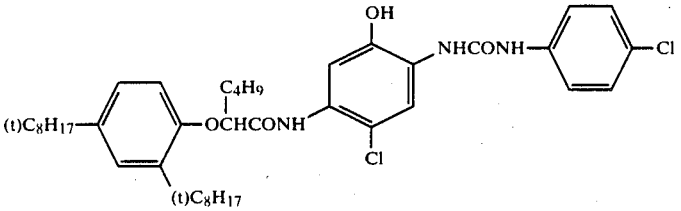

-continued (C-31)

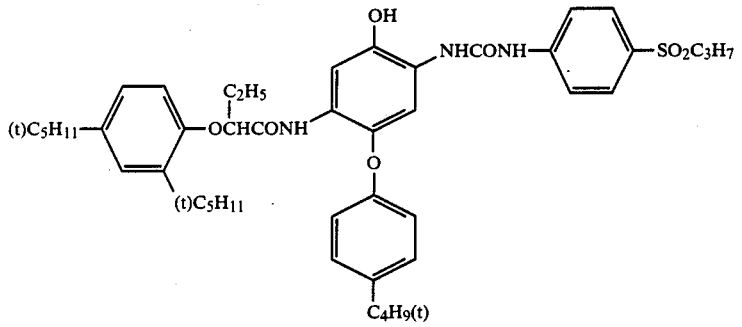

(C-32)

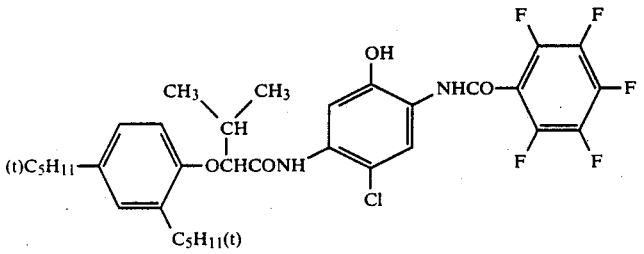

Anti-color fading agents which are the compounds represented by the general formula (A) will hereinafter be explained in detail.

R represents a hydrogen atom, an alkyl group (e.g., a methyl group, an ethyl group, an isopropyl group, a tert-butyl group, a tert-amyl group, a sec-butyl group, an n-octyl group, a tert-hexyl group, a tert-octyl group, an n-hexadecyl group and the like), an alkenyl group (e.g., an allyl group, a vinyl group and the like), an aryl group (e.g., a phenyl group, a p-methoxyphenyl group, an m-methylphenyl group, a naphthyl group and the like), or a heterocyclic group (a group having a 5- to 7-membered ring-like structure containing a nitrogen atom, an oxygen atom, a sulfur atom, a hydrogen atom and a carbon atom, such as a tetrahydropiranyl group and an imidazolyl group).

$R_6$, $R_7$, $R_8$, $R_9$ and $R_{10}$ of the general formula (A) will hereinafter be explained in detail.

$R_6$, $R_7$, $R_8$, $R_9$ and $R_{10}$ may be the same or different and each represents a hydrogen atom, an alkyl group (e.g., a methyl group, an ethyl group, an isopropyl group, a tert-butyl group, a tert-amyl group, a sec-butyl group, an n-octyl group, a tert-hexyl group, a tert-octyl group, an n-hexadecyl group, a benzyl group and the like), an alkenyl group (e.g., an allyl group, a vinyl group and the like), an aryl group (e.g., a phenyl group, a naphthyl group, a p-chlorophenyl group, a p-hydroxyphenyl group, an m-methoxyphenyl group and the like), an alkoxy group (e.g., a methoxy group, an ethoxy group, an n-butyloxy group, an n-octyloxy group and the like), an alkenoxy group (e.g., an allyloxy group and the like), an aryloxy group (e.g., a phenoxy group, a naphthyloxy group, a p-methoxyphenoxy group and the like), an alkoxycarbonyl group (e.g., a methoxycarbonyl group, a cyclohexyloxcarbonyl group, an n-butyloxycarbonyl group, an n-octyloxycarbonyl group and the like), an aryloxycarbonyl group (e.g., a phenyloxycarbonyl group, a 2,4-di-tert-amylphenoxycarbonyl group, a p-methoxyphenyloxycarbonyl group and the like), an acyl group (e.g., an acetyl group, an acryloyl group, a propionyl group, a benzoyl group and the like), a hydroxyl group, an alkylamino group (e.g., an n-butylamino group, an N,N-dibutylamino group, a cyclohexylamino group, a sec-butylamino group, an n-octylamino group, an n-hexadecylamino group and the like), an acylamino group (e.g., an acetylamino group, a propionylamino group, a dodecanoylamino group and the like), an imino group, or a halogen atom (e.g., a chlorine atom, a bromine atom and the like).

$X_4$ of the general formula (B) will hereinafter be explained in detail. $X_4$ represents a hydrogen atom, an alkyl group (e.g., a methyl group, an ethyl group, a propyl group and the like), an alkenyl group (e.g., a vinyl group, an allyl group and the like), an alkynyl group (e.g., a propynyl group), an acyl group (e.g., an acetyl group, an acryloyl group, a propionyl group, a benzoyl group and the like), a sulfonyl group (e.g., a methanesulfonyl group, an ethanesulfonyl group and the like), a sulfinyl group (e.g., a methylsulfinyl group, an ethylsulfinyl group and the like), an oxyradical group or a hydroxyl group.

$R_{11}$, $R_{12}$, $R_{13}$ and $R_{14}$ of the general formula (B) will hereinafter be explained in detail.

$R_{11}$, $R_{12}$, $R_{13}$ and $R_{14}$ may be the same or different and each represents a hydrogen atom, or an alkyl group (e.g., a methyl group, an ethyl group and the like).

A of the general formula (B) will hereinafter be explained in detail.

A represents an atomic group necessary for forming a 5-, 6- or 7-membered ring. Examples are shown below.

$$-CH_2-CH_2-CH_2-,$$

$$-CH_2-\underset{\underset{OR_{20}}{|}}{CH}-CH_2-,$$

$$-CH_2-\underset{\underset{O}{\|}}{C}-CH_2-,$$

$$-CH_2-SO_2-,$$

$$-CH_2-,$$

-continued

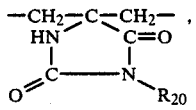

$-CH_2-CH_2-$, $-CH_2CH_2CH_2CH_2-$.

In the above formulae, $R_{20}$ represents a hydrogen atom, an alkyl group, an acyl group or a sulfonyl group.

Of the compounds represented by the general formula (B), compounds in which A represents an atomic group necessary for forming a 6-membered ring are preferred.

Representative examples of the anti-color fading agents represented by the general formulae (A) and (B) are shown below although the present invention is not limited thereto.

1.

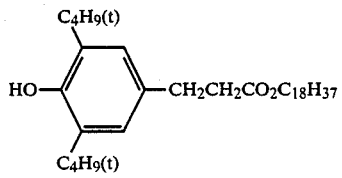

2.

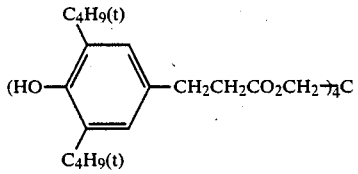

3.

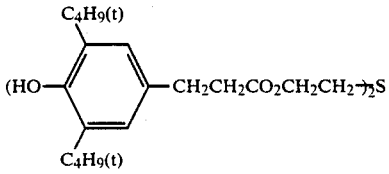

4.

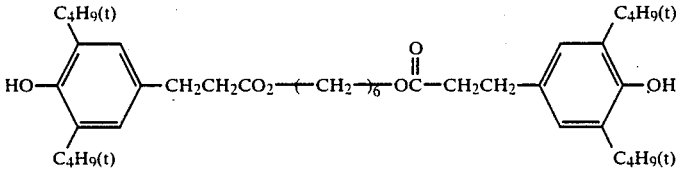

5.

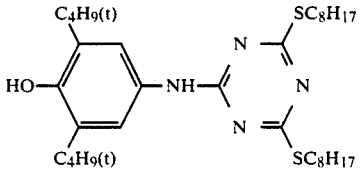

6.

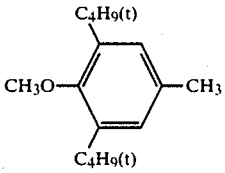

7.

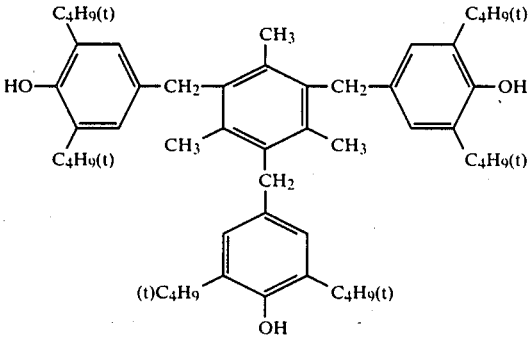

-continued
8.
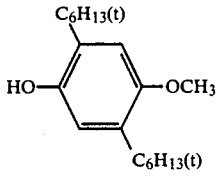
9.
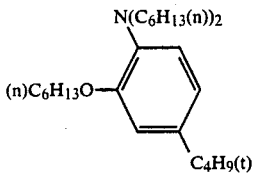
10.
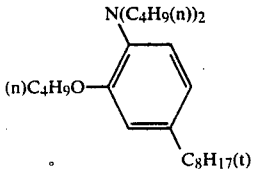
11.
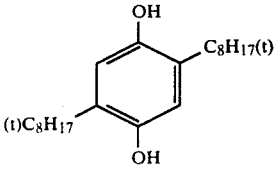
12.
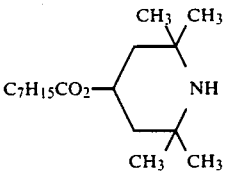
13.
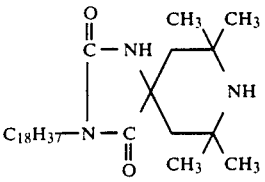
14.
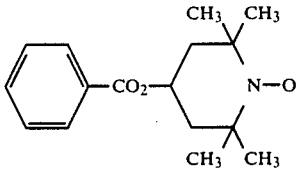
15.
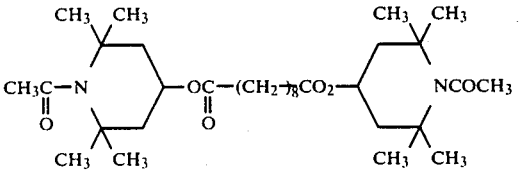
16.
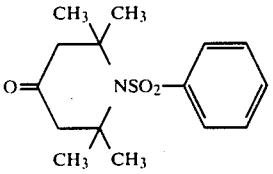

-continued
17.
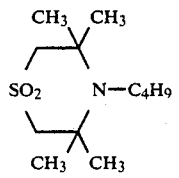
18.
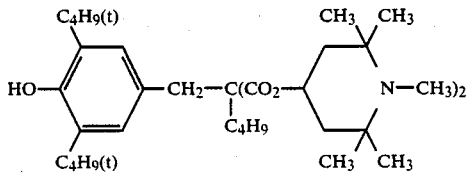
19.
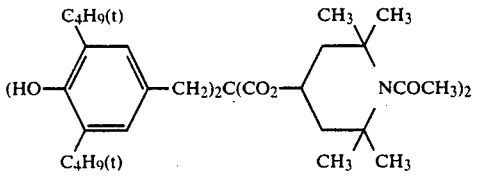
20.
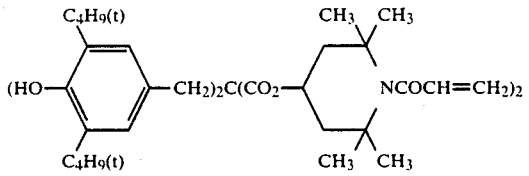
21.
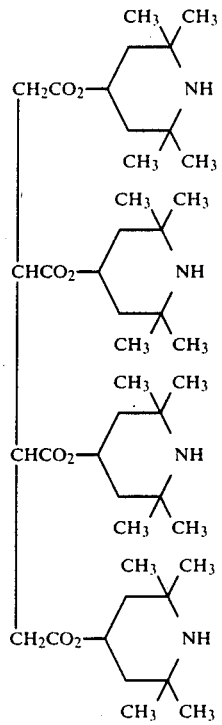

-continued

22.

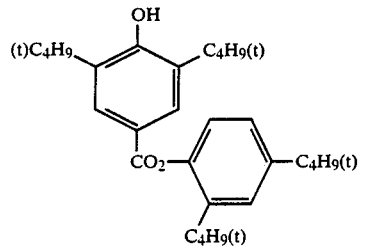

23

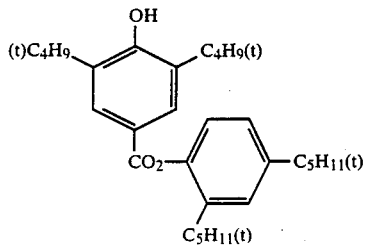

24.

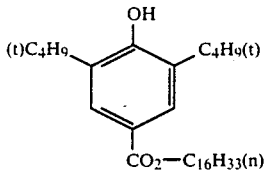

25.

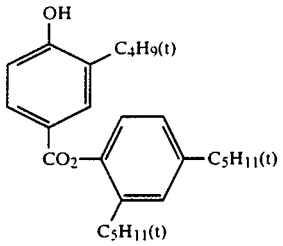

The compounds of the present invention can be prepared by the methods described in Japanese Patent Application (OPI) Nos. 48535/79, 87456/84, 3433/84, British Pat. Nos. 1,326,889, 1,354,313, 1,410,846, U.S. Pat. Nos. 3,336,135, 4,268,593, Japanese Patent Publication Nos. 1420/76, 6623/77, Japanese Patent Application (OPI) Nos. 114,036/83 and 5246/84, and also by methods similar to the above methods.

The coupler and the anti-color-fading agent which are used in the present invention can be incorporated along with a high boiling organic solvent in at least one hydrophilic organic colloid layer constituting the photographic light-sensitive layer. The color couplers represented by the general formulae (I), (II) and (III) each may be used in an amount of 0.001 to 10 mol, preferably 0.01 to 1 mol, based on 1 mol of Ag. The anti-color-fading agents represented by the general formulae (A) and (B) each may be used in an amount of 0.01 to 10 mol, preferably 0.1 to 2 mol, based on 1 mol of the color coupler of the general formula (III).

The coupler can be incorporated in a silver halide emulsion layer by known techniques such as the method described in U.S. Pat. No. 2,322,027.

The high boiling organic solvent which is used in the present invention generally has a high ability to dissolve the couplers of the present invention. In the case where the ability to dissolve the coupler is insufficiently low as a result of a decrease in the coupler solvent/coupler ratio, other coupler solvents such as phosphoric acid ester-based coupler solvents can be used in combination. In the present invention, in dissolving the coupler in the coupler solvent, an organic solvent having a boiling point of about 30° to 150° C., for example, a lower alkyl acetate such as ethyl acetate and butyl acetate, ethyl propionate, sec-butyl alcohol, methyl isobutyl ketone, β-ethoxyethyl acetate and methyl cellosolve acetate, may be allowed to be present in combination.

Even in the case where the coupler is dissolved in a coupler solvent and incorporated in a silver halide emulsion layer by the above methods, a dispersion method utilizing a polymer as described in, for example, Japanese Patent Publication No. 39853/76 and Japanese Patent Application (OPI) No. 59943/76 can be employed in combination.

In the case where the coupler has an acid group such as carboxylic acid and sulfonic acid, the coupler can be incorporated in a hydrophilic colloid as an alkaline aqueous solution.

As a binder or protective colloid which can be used in an emulsion layer of the light-sensitive material of the present invention, it is advantageous to use gelatin. Other hydrophilic colloids can be used alone or in combination with gelatin.

The gelatin which is used in the present invention may be either a lime-treated gelatin or an acid-treated gelatin. Details of a method of preparing gelatin are described in Arther Veis, *The Macromolecular Chemistry of Gelatin*, Academic Press (1964).

In a photographic emulsion layer of the photographic material of the present invention, any of silver bromide, silver iodobromide, silver iodochlorobromide, silver chlorobromide and silver chloride can be used as silver halide. A preferred example is silver chlorobromide. More preferred is silver chlorobromide containing 20 to 100 mol % of silver bromide.

The average particle size of silver halide particles in the photographic emulsion is not critical in the present invention; it is preferably not more than 2 μm. The average particle size as used herein means a particle diameter when the particle is spherical or nearly spherical, and when the particle is cubic, an edge length as determined based on the projected area.

The range of particle size may be narrow or broad.

Silver halide particles in the photographic emulsion layer may have a regular crystal form, such as cubic or octahedral, or an irregular crystal form, such as spherical or tabular, or a composite crystal form thereof. A mixture of particles having different crystal forms can be used.

In addition, an emulsion in which tabular silver halide particles with very high aspect ratio, the diameter being at least 5 times the thickness, constitute at least 50% of the total projected area can be used.

Silver halide particles may have a phase that is different between the inside and the outer layer. Silver halide particles may be such that a latent image is formed mainly on the surface of the particle, or such that a latent image is formed mainly in the inside of the particle.

Photographic emulsions which are used in the present invention can be prepared by the methods described in P. Glafkides, *Chimie et Physique Photographique*, Paul Montel (1967), G. F. Duffin, *Photographic Emulsion Chemistry*, Focal Press (1966), V. L. Zelikman et al., *Making and Coating Photographic Emulsion*, Focal Press (1964), and so forth. That is, any of the acidic method, the neutral method, the ammonia method and so forth can be employed. As a method of reacting a soluble silver salt and a soluble halogen salt, any of the single jet method, the double jet method, a combination thereof and so forth can be employed.

A method in which silver halide particles are formed in the presence of an excess of silver ions (so-called reverse mixing method) can be employed. As one system of the double jet method, a method in which pAg of a liquid layer where silver halide is formed is maintained at a constant level, that is, so-called controlled double jet method can be employed.

In accordance with this method, there can be obtained a silver halide emulsion containing silver halide particles the crystal form of which is regular and the particle size of which is nearly uniform.

Two or more silver halide emulsions prepared independently can be used as a mixture.

In the course of formation or physical ripening of silver halide particles, cadmium salts, zinc salts, lead salts, thallium salts, iridium salts or its complex salts, rhodium salts or its complex salts, iron salts or its complex salts, and the like may be present.

The silver halide emulsion is usually chemically sensitized. For this chemical sensitization, the methods described in H. Frieser, *Die Grundlagen der Photographischen Prozesse mit Silberhalogeniden*, Akademische Verlagsgesellschaft (1968, pp. 675–734) can be employed.

That is, the sulfur sensitization method using sulfur-containing compounds capable of reacting with active gelatin and silver (e.g., thiosulfuric acid salts, thioureas, mercapto compounds and rhodanines), the reduction sensitization method using reducing substances (e.g., stannous salts, amines, hydrazine derivatives, formamidinesulfinic acid and silane compounds), the noble metal sensitization method using noble metal compounds (e.g., gold complex salts, and complex salts of Group VIII metals, such as platinum, iridium and palladium, and so forth) can be used alone or in combination with each other.

In photographic emulsions which are used in the present invention can be incorporated various compounds for the purpose of preventing fog during the process of preparation, storage or photographic processing of the light-sensitive material, or of stabilizing its photographic performance. That is, a number of compounds known as antifoggants or stabilizers, for example, azoles such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (particularly 1-phenyl-5-mercaptotetrazole and the like), mercaptopyrimidines, and mercaptotriazines; thioketo compounds such as oxazorinethione; azaindenes such as triazaindenes, tetraazaindenes (particularly 4-hydroxy-substituted (1,3,3a,7)tetraazaindene), and pentaazaindenes; benzenethiosulfonic acid, benzenesulfinic acid, benzenesulfonic acid amide, and the like can be incorporated.

The photographic emulsion layer or other hydrophilic colloid layer of the photographic material of the present invention may contain various surface active agents for various purposes, such as for coating aids, or for preventing charging, improving sliding properties, improving emulsification and dispersion, preventing adhesion or improving photographic characteristics (e.g., acceleration of development, increasing contrast, and sensitization).

The photographic emulsion layer of the photographic material of the present invention may contain polyalkylene oxide or its ether, ester, amine or like derivatives, thioether compounds, thiomorpholines, quaternary ammonium salt compounds, urethane derivatives, urea derivatives, imidazole derivatives, 3-pyrazolidones and the like for the purpose of, e.g., increasing sensitivity or contrast, or of accelerating development.

The photographic material of the present invention can contain a dispersion of a water-insoluble or sparingly water-soluble synthetic polymer in its photographic emulsion layer or other hydrophilic colloid layer for the purpose of, e.g., improving dimensional stability.

The photographic emulsion which is used in the present invention may be subjected to spectral sensitization using methine dyes and the like. Dyes which can be used for this spectral sensitization include cyanine dyes, merocyanine dyes, composite cyanine dyes, composite merocyanine dyes, holopolar cyanine dyes, hemicyanine dyes, styryl dyes and hemioxonol dyes. Particularly useful dyes are dyes belonging to the cyanine dyes, merocyanine dyes and composite merocyanine dyes. To these dyes can be applied any of nuclei which are commonly utilized for cyanine dyes as basic heterocyclic nuclei. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, and a pyridine nucleus; nuclei resulting from fusion of the above nuclei and alicyclic hydrocarbon rings; and nuclei resulting from fusion of the above nuclei and aromatic hydrocarbon rings, i.e., an indolenine nucleus, a benzidolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus and the like can be applied. These nuclei may be substituted at its carbon atom.

To merocyanine dyes or composite merocyanine dyes can be applied, as nuclei having the ketomethylene structure, 5- and 6-membered heterocyclic nuclei such as a pyrazoline-5-one nucleus, a thiohydantoin nucleus, a 2-thiooxazolidine-2,4-dione nucleus, a thiazolidine-2,4-dione, a rhodanine nucleus, and a thiobarbituric acid nucleus.

These sensitizing dyes may be used singly or in combination with each other. Compositions of sensitizing dyes are often used for the purpose of supersensitization.

In combination with such sensitizing dyes, dyes not having a spectral sensitization action by themselves or substances not substantially absorbing visible light but exhibiting supersensitization may be incorporated in the emulsion. For example, aminostyryl compounds substituted with a nitrogen-containing heterocyclic group (described in, for example, U.S. Pat. Nos. 2,933,390 and 3,635,721), aromatic organic acid-formaldehyde condensates (described in, for example, U.S. Pat. No. 3,743,510), cadmium salts, and azaindene compounds may be incorporated.

In the layers in combination with the couplers represented by the above formulae (I), (II) and (III), or in the other layers, other dye-forming couplers, i.e., compounds capable of forming color through oxidative coupling with an aromatic primary amine developer (e.g., phenylenediamine derivatives and aminophenol derivatives) at the color developing processing may be incorporated. Examples of magenta couplers are a 5-pyrazolone coupler, a pyrazolobenzimidazole coupler, a pyrazolo[5,1-c][1,2,4]triazole coupler, a pyrazolopyrazole coupler, a pyrazolotetrazole coupler, and an open chain acetylacetonitrile coupler. Examples of yellow couplers are acetylacetamide couplers (e.g., benzoylacetanilides and pivaloylacetanilides). Examples of cyan couplers are a naphthol coupler and a phenyl coupler. Nondiffusible couplers having a hydrophobic group called a ballast group in the molecule thereof, or polymerized couplers are desirable. These couplers may be 4-equivalent or 2-equivalent relative to silver ion. In addition, colored couplers having a color correction effect, or couplers releasing a development inhibiting agent with development (so-called DIR couplers) can be incorporated.

In addition to DIR couplers, non-color-forming DIR coupling compounds producing a colorless coupling reaction product and releasing a development inhibiting agent may be incorporated. In addition to the DIR couplers, compounds releasing a development inhibiting agent with development may be incorporated in the light-sensitive material. Couplers or compounds releasing a development accelerator with development may be incorporated in the light-sensitive material.

The couplers of the present invention and the above couplers can be incorporated as a mixture comprising two or more thereof in the same layer in order to satisfy the characteristics required for the light-sensitive material, or the same compound may be incorporated in two or more different layers.

The photographic emulsion layer or other hydrophilic colloid layer of the photographic material of the present invention may contain inorganic or organic hardeners. For example, chromium salts (e.g., chromium alum and chromium acetate), aldehydes (e.g., formaldehyde, glyoxal and glutaraldehyde), N-methylol compounds (e.g., dimethylolurea and methyloldimethylhydantoin), dioxane derivatives (e.g., 2,3-dihydroxydioxane), active vinyl compounds (e.g., 1,3,5-triacryloylhexahydro-s-triazine and 1,3-vinylsulfonyl-2-propanol), active halogen compounds (e.g., 2,4-dichloro-6-hydroxy-s-triazine), and mucohalogenic acids (e.g., mucochloric acid and mucophenoxychloric acid) can be used alone or in combination with each other.

In the case where the hydrophilic colloid layer of the light-sensitive material of the present invention contains additives such as dyes and ultraviolet absorbers, the additives may be mordanted with cationic polymers, for example.

The light-sensitive material of the present invention may contain, as anti-color-foggants, hydroquinone derivatives, aminophenol derivatives, gallic acid derivatives, ascorbic acid derivatives, and so on.

The light-sensitive material of the present invention may contain an ultraviolet absorber in its hydrophilic colloid layer. Examples of ultraviolet absorbers which can be used are benzotriazole compounds substituted with an aryl group (e.g., compounds described in U.S. Pat. No. 3,535,794), 4-thiazolidone compounds (e.g., compounds described in U.S. Pat. Nos. 3,314,794 and 3,352,681), benzophenone compounds (e.g., compounds described in Japanese Patent Application (OPI) No. 2784/71), cinnamic acid ester compounds (e.g., compounds described in U.S. Pat. Nos. 3,705,805 and 3,707,375), butadiene compounds (e.g., compounds described in U.S. Pat. No. 4,045,229), and benzoxazole compounds (e.g., compounds described in U.S. Pat. No. 3,700,455). In addition, ultraviolet absorbing couplers (e.g., α-naphthol-based cyan dye-forming couplers) and ultraviolet absorbing polymers can be used. These ultraviolet absorbers may be mordanted in a specified layer.

The light-sensitive material of the present invention may contain water-soluble dyes as filter dyes or for the purpose of, e.g., preventing irradiation in its hydrophilic colloid layer. Dyes which can be used include oxonol dyes, hemioxonol dyes, styryl dyes, merocyanine dyes, cyanine dyes and azo dyes. Of these dyes, oxonol dyes, hemioxonol dyes and merocyanine dyes are particularly useful.

In the present invention, in addition to the anti-fading agents represented by the general formulae (A) and (B), known anti-fading agents as described below can be used in combination. Color image-stabilizing agents which are used in the present invention can be used alone or in combination with each other. Such known anti-fading agents include hydroquinone derivatives, gallic acid derivatives, p-alkoxyphenols, p-oxyphenol derivatives and bisphenols.

In photographic processing of layers comprising the photographic emulsion of the present invention, any known processing methods and processing solutions as described in *Research Disclosure*, No. 176, pp. 28 to 30 can be applied. The processing temperature is usually chosen from the range of 18° to 50° C., but the processing may be carried out at temperatures higher than 50° C. or lower than 18° C.

Fixers having commonly used compositions can be used. As fixing agents, as well as thiosulfuric acid salts and thiocyanic acid salts, organic sulfur compounds known to be effective as fixing agents can be used. These fixers may contain water-soluble aluminum salts as hardeners.

A color developer generally comprises an alkaline aqueous solution containing a color developing agent. As such color developing agents, known primary aromatic amine developing agents, e.g., phenylenediamines such as 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, and 4-amino-3-methyl-N-ethyl-N-β-methoxyethylaniline can be used.

In addition, compounds described in L.F.A. Mason, *Photographic Processing Chemistry*, Focal Press (1966), pp. 226 to 229, U.S. Pat. Nos. 2,193,015, 2,592,364, and Japanese Patent Application (OPI) No. 64933/73 may be used.

The color developer may contain pH buffers such as the sulfuric acid salts, carbonic acid salts, boric acid salts and phosphoric acid salts of alkali metals, development inhibitors such as bromides, iodides and organic antifoggants, and antifoggants. If necessary, the color developer may further contain a hard water softening agent, a preservative (e.g., hydroxylamine), an organic solvent (e.g., benzyl alcohol and diethylene glycol), a development accelerator (e.g., polyethylene glycol, quaternary ammonium salts and amines), a dye-forming coupler, a competitive coupler, a foggant (e.g., sodium boron hydride), an auxiliary developing agent (e.g., 1-phenyl-3-pyrazolidone), a tackifier, a polycarboxylic acid-based chelating agent, an antioxidant and so forth.

After color development, the photographic emulsion layer is usually bleached. This bleach processing may be carried out simultaneously with a fix processing, or these bleach and fix processings may be carried out independently. Bleaching agents which can be used include polyvalent metal (e.g., iron (III), cobalt (III), chromium (VI) and copper (II)) compounds, peracids, quinones, and nitroso compounds.

Examples are ferricyanides, perchromic acid salts, and the organic complex salts of iron (III) or cobalt (III), e.g., the complex salts of organic acids such as aminopolycarboxylic acids (e.g., ethylenediaminetetraacetic acid, nitrilotriacetic acid, and 1,3-diamino-2-propanoltetraacetic acid), citric acid, tartaric acid and malic acid; persulfuric acid salts and permanganic acid salts; nitrosophenol and the like. Of these compounds, potassium ferricyanide, sodium iron (III) ethylenediaminetetraacetate and iron (III) ammonium ethylenediaminetetraacetate are particularly useful. Ethylenediaminetetraacetic acid iron (III) complex salts are useful both in an independent bleaching solution or in a monobath bleach-fixing solution.

Color photographic emulsion layers constituting the dye image layers of the present invention are coated on a commonly used flexible support, e.g., a plastic film, paper and cloth. Useful examples of such flexible supports are films of semisynthetic or synthetic polymers, such as cellulose acetate, cellulose acetate butyrate, polystyrene, polyethylene terephthalate and polycarbonate, and cloth or paper coated with a baryta layer or α-olefin polymers (e.g., polyethylene and polypropylene). The support may be colored with dyes or pigments. For the purpose of shielding light, the support may be colored in black.

In this invention the support is used for a reflective material, and it is preferred that white pigment be incorporated in the support or a laminated layer. White pigments which can be used include titanium dioxide, barium sulfate, zinc oxide, zinc sulfide, calcium carbonate, antimony trioxide, silica white, aluminum white, and titanium phosphate. Of these compounds, titanium dioxide, barium sulfate and zinc oxide are particularly preferred.

The surface of the support is usually subjected to a subbing treatment in order to improve its adhesion to photographic emulsions and so on. The surface of the support may be subjected to treatment such as corona discharging, irradiation with ultraviolet rays and flame treatment before or after the subbing treatment.

A hydrophilic colloid layer containing a high concentration of white pigment can be sandwiched between the support and the emulsion layer to increase whiteness and sharpness of photographic images.

In a reflective material containing the magenta coupler of the present invention, as the support, a paper support laminated with a polymer is often used. It is particularly preferred to use a synthetic resin film with a white pigment kneaded therein, because use of such films increases smoothness, luster and sharpness and provides photographic images particularly excellent in reproducing light and dark area. In this case, as synthetic resins, polyethylene terephthalate and cellulose acetate are particularly useful and as white pigments, barium sulfate and titanium oxide are particularly useful.

The surface and the back of the photographic material of the present invention can be laminated with a plastic film after development and drying. Plastics which can be used for the lamination include polyolefins, polyesters, polyacrylates, polyvinyl acetate, polystyrenes, a butadiene-styrene copolymer, and polycarbonates. In particular, polyethylene terephthalate, a copolymer of vinyl alcohol and ethylene, and polyethylene are useful.

The present invention is described in greater detail with reference to the following examples, although it is not limited thereto.

Unless otherwise specified, all ratios, percents, etc., are by weight.

EXAMPLE 1

A paper with polyethylene laminated on both sides thereof was coated with the first layer (lowermost layer) to the seventh layer (uppermost layer) as shown in Table 1 to prepare color photographic materials A to D.

A coating solution for the first layer was prepared as follows.

100 g of a yellow coupler shown in Table 1 was dissolved in a mixed solvent of 166.7 ml of dibutyl phthalate and 200 ml of ethyl acetate. The solution thus prepared was emulsified and dispersed in 800 g of a 10% aqueous gelating solution containing 80 ml of a 1% aqueous sodium dodecylbenzenesulfonate solution. Then, the whole emulsion was mixed with 1,450 g of a blue-sensitive silver chlorobromide emulsion (Br: 80%;

Ag: 66.7 g) to prepare a coating solution. Coating solutions for the other layers were prepared in the same manner as above.

As a hardener for each layer, a 2,4-dichloro-6-hydroxy-s-triazine sodium salt was used.

As spectral sensitizers for the emulsions, the following were used.

Blue-Sensitive Emulsion Layer 3,3'-Di(γ-sulfopropyl)selenacyanine sodium salt ($2\times10^{-4}$ mol per mol of silver halide).

Green-Sensitive Emulsion Layer 3,3'-Di(γ-sulfopropyl)-5,5'-diphenyl-9-ethyloxacarbocyanine sodium salt ($2.5\times10^{-4}$ mol per mol of silver halide).

Red-Sensitive Emulsion Layer 3,3'-Di(γ-sulfopropyl)-9-methylthiadicarbocyanine sodium salt ($2.5\times10^{-4}$ mol per mol of silver halide).

Irradiation-preventing dyes used for the emulsion layers are shown below.

The other layers were prepared in the same manner as in the preparation of the first layer.

TABLE 1

| | |
|---|---|
| Seventh Layer: Protective Layer | |
| Gelatin | 1,600 mg/m$^2$ |
| Sixth Layer: Ultraviolet Absorbing Layer | |
| Ultraviolet absorber (*a) | 350 mg/m$^2$ |
| Solvent (*b) | 140 mg/m$^2$ |
| Gelatin | 1,000 mg/m$^2$ |
| Fifth Layer: Red-Sensitive Layer | |
| Silver bromide emulsion (silver bromide: 80 mol %) (calculated as silver) | 250 mg/m$^2$ |
| Cyan coupler (*c) | 400 mg/m$^2$ |
| Solvent (*b) | 200 mg/m$^2$ |
| Gelatin | 600 mg/m$^2$ |
| Fourth Layer: Color Mixing Preventing Layer | |
| Color mixing preventing agent (*d) | 200 mg/m$^2$ |
| Ultraviolet absorber (*a) | 150 mg/m$^2$ |
| Solvent (*b) | 140 mg/m$^2$ |
| Gelatin | 1,000 mg/m$^2$ |
| Third Layer: Green-Sensitive Layer | |
| Silver chlorobromide emulsion (silver bromide: 80 mol %) (calculated as silver) | 180 mg/m$^2$ |
| Magenta coupler (*e) | 270 mg/m$^2$ |
| Fading preventing agent (*f) | 150 mg/m$^2$ |
| Solvent (*g) | 170 mg/m$^2$ |
| Gelatin | 1,000 mg/m$^2$ |
| Second Layer: Color Mixing Preventing Layer | |
| Color mixing preventing agent (*d) | 200 mg/m$^2$ |
| Solvent (*b) | 80 mg/m$^2$ |
| Gelatin | 1,000 mg/m$^2$ |
| First Layer: Blue-Sensitive Layer | |
| Silver chlorobromide emulsion (silver bromide: 80 mol %) (calculated as silver) | 400 mg/m$^2$ |
| Yellow coupler (*h) | 680 mg/m$^2$ |
| Solvent (*b) | 280 mg/m$^2$ |
| Gelatin | 1,200 mg/m$^2$ |
| Support | |
| Paper support with polyethylene laminated on both sides thereof | |

TABLE 1-continued (*a) 2-(2-Hydroxy-3-sec-butyl-5-tert-butylphenyl)benzo-triazole
(*b) Dibutyl phthalate
(*c) 2-[α-(2,4-di-tert-amylphenoxy)butyramido]-2,4-dichloro-5-ethylphenol
(*d) 2,5-Di-tert-octylhydroquinone
(*e) 1-(2,4,6-Trichlorophenyl)-3-(2-chloro-5-tetra-decanamido)anilino-4-(2-butoxy-5-di-tert-octyl-phenylthio)-5-pyrazalone
(*f) 3,3,3',3'-Tetramethyl-5,6,5',6'-tetrapropyloxy-bis-1,1'-spiroindane
(*g) Trioctyl phosphate
(*h) α-Pivalyl-α-(3-benzyl-4-ethoxy-1-hydantoinyl-2-chloro-α-[5-(2,4-di-tert-amylphenoxy]butyramidoacetanilide (Y-1)

IRRADIATION PREVENTING DYES

Green-Sensitive Emulsion Layer

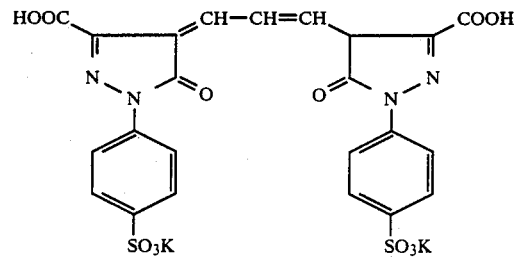

Red-Sensitive Emulsion Layer

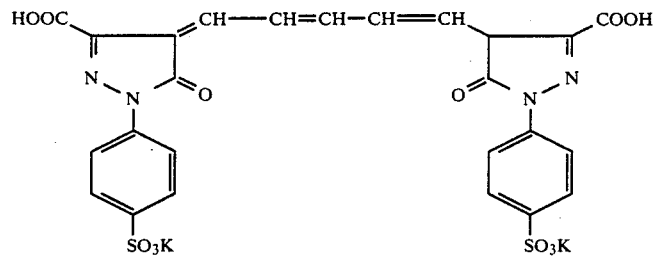

Samples B, C and D were prepared in the same manner as in the preparation of Sample A except that the type of the couplers and the fading preventing agent were changed as shown in Table 2.

TABLE 2

| | First Layer | | | Fifth Layer | |
|---|---|---|---|---|---|
| Sample No. | Yellow Coupler | Fading Preventing Agent | Third Layer Magenta Coupler | Cyan Coupler | Fading Preventing Agent |
| A (Comparison) | (Y-11) | None | Table 1 (*e) | Table 1 (*c) | None |
| B (Comparison) | " | " | (M-13) | (C-5) | " |
| C (Invention) | " | No. 20 | " | " | " |
| D (Invention) | " | " | " | " | No. 20 |

Samples A to D were each printed through a color negative film which had been pictured and developed by the use of a color printer, and then developed according to the following procedure.

| Processing steps | Temperature (°C.) | Time (minutes) |
|---|---|---|
| Color Development | 33 | 3.5 |
| Bleach-Fixing | 33 | 1.5 |

-continued

| | | |
|---|---|---|
| Water Washing | 25–35 | 3 |
| Drying | 80 | |

| Composition of Color Developer: | |
|---|---|
| Trisodium Nitrilotriacetate | 2.0 g |
| Benzyl Alcohol | 15 ml |
| Diethylene Glycol | 10 ml |
| Sodium Sulfite | 2.0 g |
| Potassium Bromide | 0.5 g |
| Hydroxylamine Sulfate | 3.0 g |
| 4-Amino-3-methyl-N—ethyl-N—[β-(methanesulfonamido)ethyl]-p-phenylenediamine Sulfate | 5.0 g |
| Sodium Carbonate (monohydrate) | 30 g |
| Water to make | 1,000 ml (pH = 10.1) |

| Composition of Bleach-Fixer: | |
|---|---|
| Ammonium Thiosulfate (70 wt %) | 150 ml |
| Sodium Sulfite | 15 g |
| Iron Ammonium Ethylenediaminetetra-acetate | 55 g |
| Disodium Ethylenediaminetetraacetate | 4 g |
| Water to make | 1,000 ml |

The above developed samples were each measured for the optical density for green light. The results are shown in Table 3.

As compared with the color print produced from Sample A containing the comparative coupler, the color prints produced from Samples B, C and D containing the couplers of the present invention are excellent in reproduction of colors of high saturation as well as red, blue and green.

Each sample was exposed to white light through a continuous wedge and processed in the same manner as above to obtain a gray image. These samples were irradiated with light for 6 days by the use of a Xenon tester (illumination: 130,000 lux) and were subjected to a light fading test. After the test, areas having a density of 1.0 before the test and white areas were measured for the density by the use of a Macbeth RD-514 densitometer. The results are shown in Table 3.

TABLE 3

| | Irradiation with Xenon Lamp for 6 Days | | | |
|---|---|---|---|---|
| Sample No. | $D_B$ | $D_G$ | $D_R$ | $D_B$ of White Area |
| A (Comparison) | 0.75 | 0.72 | 0.78 | 0.25 |
| B (Comparison) | 0.58 | 0.94 | 0.85 | 0.13 |
| C (Invention) | 0.93 | 0.92 | 0.85 | 0.12 |
| D (Invention) | 0.94 | 0.93 | 0.94 | 0.11 |

It can be seen from the results of Table 3 that as compared with Samples A and B, Samples C and D of the present invention are decreased in fading of each color and formation of stain in the white area, and in particular, such improvements are marked in Sample D.

EXAMPLE 2

Color photographic materials E and F were prepared by coating a paper with polyethylene laminated on both sides with the first layer to the seventh layer as shown in Table 4.

A coating solution for the first layer was prepared in the same manner as in Example 1 except that a 1% aqueous solution of Alkanol B (sodium alkylnaphthalenesulfonate produced by Du Pont Corp.) was used in place of a 1% aqueous solution of sodium dodecylbenzenesulfonate, and 1,2-bis(vinylsulfonyl)ethane was used in place of 2,4-dichloro-6-hydroxy-s-triazine sodium salt.

TABLE 4

| Sample E (Comparison) | |
|---|---|
| Seventh Layer: Protective Layer | |
| Gelatin | 600 mg/m² |
| Sixth Layer: Ultraviolet Absorbing Layer | |
| Ultraviolet absorber (*a) | 260 mg/m² |
| Ultraviolet absorber (*b) | 70 mg/m² |
| Solvent (*c) | 300 mg/m² |
| Solvent (*d) | 100 mg/m² |
| Gelatin | 700 mg/m² |
| Fifth Layer: Red-Sensitive Layer | |
| Silver chlorobromide emulsion (silver bromide: 74 mol %) (calculated as silver) | 210 mg/m² |
| Cyan coupler (*e) | 400 mg/m² |
| Solvent (*c) | 160 mg/m² |
| Solvent (*d) | 100 mg/m² |
| Gelatin | 1,800 mg/m² |
| Fourth Layer: Color Mixing Preventing Layer | |
| Color mixing preventing agent (*f) | 65 mg/m² |
| Ultraviolet absorber (*a) | 450 mg/m² |
| Ultraviolet absorber (*b) | 230 mg/m² |
| Solvent (*c) | 50 mg/m² |
| Solvent (*d) | 50 mg/m² |
| Gelatin | 1,700 mg/m² |
| Third Layer: Green-Sensitive Layer | |
| Silver chlorobromide emulsion (silver bromide: 74 mol %) (calculated as silver) | 305 mg/m² |
| Magenta coupler (*g) | 670 mg/m² |
| Fading preventing agent (*h) | 150 mg/m² |
| Fading preventing agent (*i) | 10 mg/m² |
| Solvent (*c) | 200 mg/m² |
| Solvent (*d) | 10 mg/m² |
| Gelatin | 1,400 mg/m² |
| Second Layer: Color Mixing Preventing Layer | |
| Silver bromide emulsion (calculated as silver) | 10 mg/m² |
| Color mixing preventing agent (*f) | 55 mg/m² |
| Solvent (*c) | 30 mg/m² |
| Solvent (*d) | 15 mg/m² |
| Gelatin | 800 mg/m² |
| First Layer: Blue-Sensitive Layer | |
| Silver chlorobromide emulsion (silver bromide: 90 mol %) (calculated as silver) | 290 mg/m² |
| Yellow Coupler (Y-13) | 600 mg/m² |
| Solvent (*c) | 30 mg/m² |
| Solvent (*d) | 15 mg/m² |
| Gelatin | 1,800 mg/m² |
| Support | |
| Paper with polyethylene laminated on both sides | |
| Sample F (Invention) | |
| Seventh Layer: Protective Layer | |
| Gelatin | 600 mg/m² |
| Sixth Layer: Ultraviolet Absorbing Layer | |
| Ultraviolet absorber (*a) | 260 mg/m² |
| Ultraviolet absorber (*b) | 70 mg/m² |
| Solvent (*c) | 300 mg/m² |
| Solvent (*d) | 100 mg/m² |
| Gelatin | 700 mg/m² |
| Fifth Layer: Red-Sensitive Layer | |
| Silver chlorobromide emulsion (silver bromide: 74 mol %) (calculated as silver) | 210 mg/m² |
| Cyan Coupler (C-32) | 350 mg/m² |
| Fading preventing agent (No. 23) | 250 mg/m² |
| Solvent (*c) | 160 mg/m² |
| Solvent (*d) | 100 mg/m² |
| Gelatin | 1,800 mg/m² |
| Fourth Layer: Color Mixing Preventing Layer | |
| Color mixing preventing agent (*f) | 65 mg/m² |
| Ultraviolet absorber (*a) | 450 mg/m² |
| Ultraviolet absorber (*b) | 230 mg/m² |
| Solvent (*c) | 50 mg/m² |
| Solvent (*d) | 50 mg/m² |
| Gelatin | 1,700 mg/m² |
| Third Layer: Green-Sensitive Layer | |
| Silver chlorobromide emulsion | 150 mg/m² |

TABLE 4-continued

| | |
|---|---|
| (silver bromide: 74 mol %) (calculated as silver) | |
| Magenta Coupler (M-40) | 240 mg/m$^2$ |
| Fading preventing agent (*h) | 150 mg/m$^2$ |
| Fading preventing agent (*i) | 10 mg/m$^2$ |
| Solvent (*c) | 200 mg/m$^2$ |
| Solvent (*d) | 10 mg/m$^2$ |
| Gelatin | 1,400 mg/m$^2$ |
| Second Layer: Fading Preventing Layer | |
| Silver bromide emulsion (calculated as silver) | 10 mg/m$^2$ |
| Color mixing preventing agent (*f) | 55 mg/m$^2$ |
| Solvent (*c) | 30 mg/m$^2$ |
| Solvent (*d) | 15 mg/m$^2$ |
| Gelatin | 800 mg/m$^2$ |
| First Layer: Blue-Sensitive Layer | |
| Silver chlorobromide emulsion (silver bromide: 90 mol %) (calculated as silver) | 290 mg/m$^2$ |
| Yellow Coupler (Y-13) | 600 mg/m$^2$ |
| Fading preventing agent (No. 23) | 280 mg/m$^2$ |
| Solvent (*c) | 30 mg/m$^2$ |
| Solvent (*d) | 15 mg/m$^2$ |
| Gelatin | 1,800 mg/m$^2$ |
| Support | |
| Paper with polyethylene laminated on both sides | |

(*a) 2-(2-Hydroxy-3,5-di-tert-amylphenyl)benzotriazole
(*b) 2-(2-Hydroxy-3,5-di-tert-butylphenyl)benzotriazole
(*c) Di(2-ethylhexyl) phthalate
(*d) Dibutyl phthalate
(*e) 2,4-Dichloro-3-methyl-6-[α-(2,4-di-tert-amylphenoxy)-butyramido]phenol
(*f) 2,5-Di-tert-octylhydroquinone
(*g) 1-(2,4,6-Trichlorophenyl)-3-[2-chloro-5-(3-octenyl-succinimido)anilino]-5-pyrazolone
(*h) 1,4-Di-tert-amyl-2,5-dioctyloxybenzene
(*i) 2,2'-Methylenebis(4-methyl-6-tert-butylphenol)

As sensitizing dyes for the emulsion layers, the following were used.

Blue-Sensitive Emulsion Layer

Anhydro-5-methoxy-5'-methyl-3,3'-disulfopropylselenacyanine hydroxide ($2.5\times10^{-4}$ mol per mol of silver halide).

Green-Sensitive Emulsion Layer

Anhydro-9-ethyl-5,5'-diphenyl-3,3'-disulfoethyloxacarbocyanine hydroxide ($2\times10^{-4}$ mol per mol of silver halide).

Red-Sensitive Emulsion Layer 3,3'-Diethyl-5-methoxy-9,9'-(2,2-dimethyl-1,3-propano)thiadicarbocyanine iodide ($2\times10^{-4}$ mol per mol of silver halide).

Sample E and F were each printed through a color negative film which had been pictured and developed by the use of a color printer, and then processed in the same manner as in Example 1. With a color print produced from Sample F, the saturation of pure colors such as red, blue and green is high as compared with a color print produced from Sample E, and greatly satisfactory color reproduction can be obtained.

The same fading test as in Example 1 was performed, and the results are shown in Table 5.

TABLE 5

| | Irradiation with Xenon Lamp for 6 Days | | | |
|---|---|---|---|---|
| Sample No. | $D_B$ | $D_G$ | $D_R$ | $D_B$ of White Area |
| E (Comparison) | 0.70 | 0.69 | 0.77 | 0.27 |
| F (Invention) | 0.90 | 0.91 | 0.92 | 0.12 |

It can be seen from the results of Table 5 that the light fastness of the image in Sample F is greatly improved over that of the image in Sample E.

Similar results were obtained even when in Sample F the cyan coupler was replaced with (C-1), (C-5), (C-10), (C-11), or an equimolar mixture of (C-5) and *c in Table 1, the magenta coupler was replaced with (M-1), (M-7), (M-11), (M-13) or (M-31), the yellow coupler was replaced with (Y-5), (Y-9), (Y-11) or (Y-12), and the fading preventing agents of the first and fifth layers were replaced with No. 5, No. 20 or No. 25.

While the invention has been described in detail and with reference to specific embodiments thereof, it will be apparent to one skilled in the art that various changes and modifications can be made therein without departing from the spirit and scope thereof.

What is claimed is:

1. A multilayer silver halide color photographic material comprising a reflective support and a blue-sensitive emulsion layer containing at least one yellow coupler represented by the general formula (I), a green-sensitive emulsion layer containing at least one magenta coupler represented by the general formula (II) and a red-sensitive emulsion layer containing at least one cyan coupler represented by the general formula (III) provided on the freflective support, and wherein the blue-sensitive emulsion layer contains at least one compound represented by the general formulae (A) or (B):

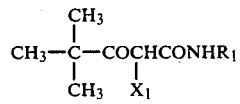
(I)

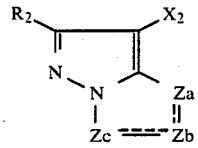
(II)

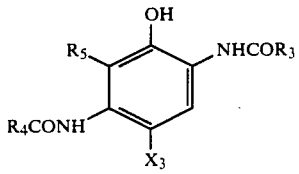
(III)

in the general formulae (I), (II) and (III), $R_1$, $R_2$ and $R_3$ each represents a substituent, and $R_4$ and $R_5$ in combination form a 5- or 6-membered nitrogen-containing ring; and $X_1$, $X_2$ and $X_3$ each represents a hydrogen atom or group capable of leaving upon a coupling reaction with an oxidized aromatic primary amine; in the general formula (II), Za, Zb and Zc each represents methine, substituted methine, =N— or —NH—; one of the Za-Zb bond and the Zb-Zc bond is a double bond and the other is a single bond; when the Zb-Zc bond is a carbon-carbon double bond, the Zb-Zc bond is included as a part of the aromatic ring, and when $R_2$ or $X_2$ forms a dimer or a higher polymer, or Za, Zb or Zc is substituted methine, the substituted methine is included as at least a part of a dimer or a higher polymer;

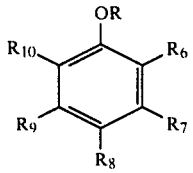
(A)

-continued (B)

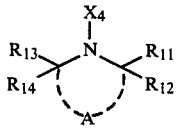

wherein R represents a hydrogen atom, an alkyl group, an alkenyl group, an aryl group or a heterocyclic group; $R_6$, $R_7$, $R_8$, $R_9$ and $R_{10}$ may be the same or different and each represents a hydrogen atom, an alkyl group, an alkenyl group, an aryl group, an alkoxy group, an alkenoxy group, an aryloxy group, an alkoxycarbonyl group, an aryloxycarbonyl group, an acyl group, a hydroxyl group, an alkylamino group, an acylamino group, an imino group or a halogen atom; $R_{11}$, $R_{12}$, $R_{13}$ and $R_{14}$ may be the same or different and each represents a hydrogen atom or an alkyl group; $X_4$ represents a hydrogen atom, an alkyl group, an alkenyl group, an alkynyl group, an acyl group, a sulfonyl group, a sulfinyl group, an oxyradical group or a hydroxyl group; and A represents a non-metallic atom group necessary to form a 5-, 6- or 7-membered ring.

2. A multilayer silver halide color photographic material according to claim 1, wherein $R_1$ in the general formula (I) represents an aromatic group, an alkoxy group or a heterocyclic group; and $X_1$ represents a hydrogen atom, a halogen atom, a carboxyl group or a group linked to a carbon atom at the coupling position through an oxygen atom, a nitrogen atom or a sulfur atom and capable of leaving upon coupling.

3. A multilayer silver halide color photographic material according to claim 1, wherein $X_1$ in the general formula (I) represents a divalent group and may form a bisbody.

4. A multilayer silver halide color photographic material according to claim 1, wherein a yellow coupler of the general formula (I) represents compounds of the general formulae (Y-5), (Y-9), (Y-11), (Y-12) or (Y-13):

(Y-5)

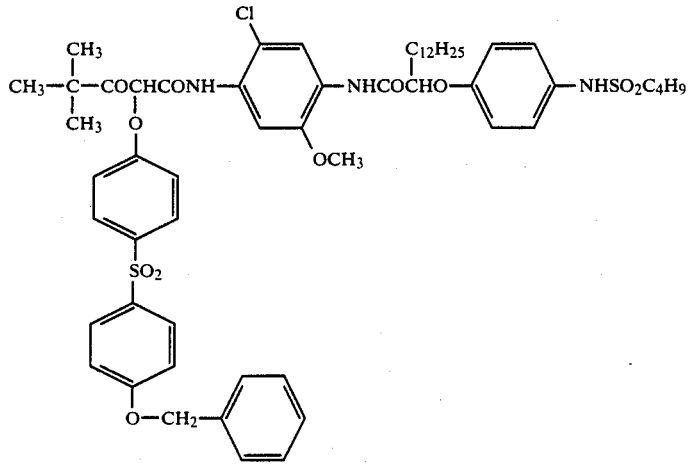

(Y-9)

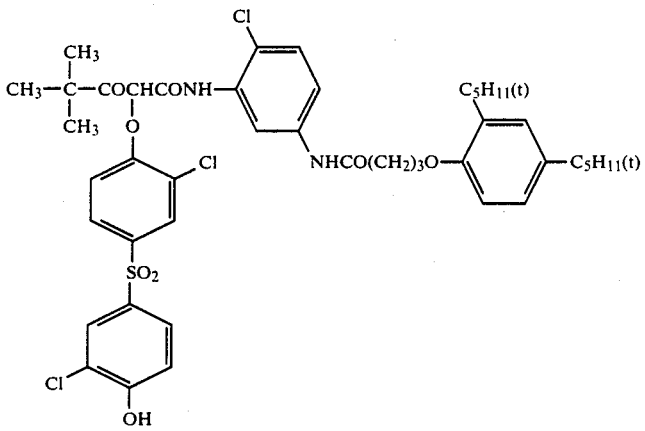

(Y-11)

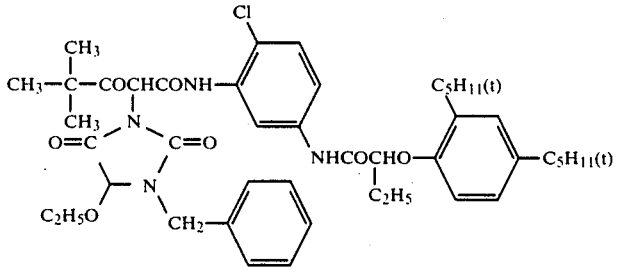

-continued (Y-12)

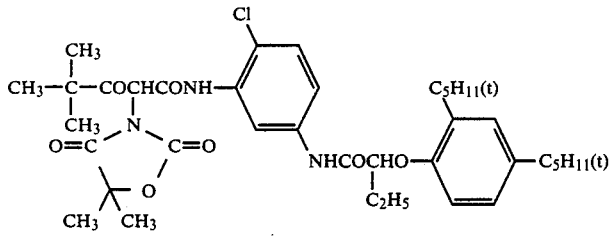

(Y-13)

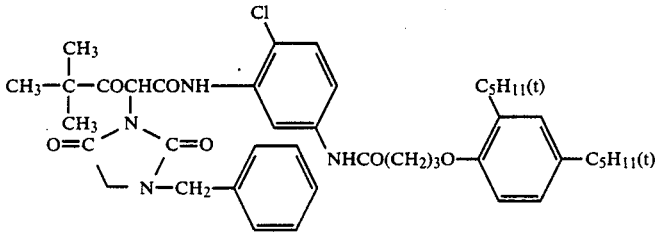

5. A multilayer silver halide color photographic material according to claim 1, wherein magenta coupler of the general formula (II) represents the general formulae (II-a), (II-b), (II-c), (II-d), (II-e), (II-f) and (II-g):

(II-a)

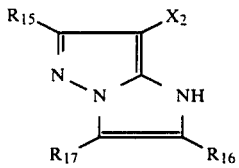

(II-b)

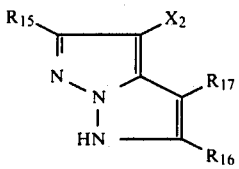

(II-c)

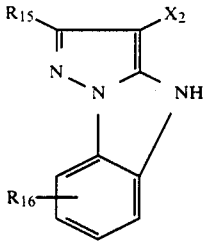

(II-d)

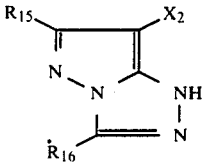

(II-e)

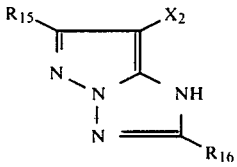

-continued (II-f)

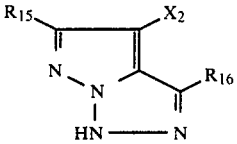

(II-g)

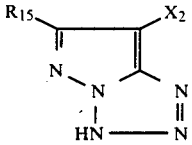

wherein $X_2$ is as defined above, and $R_{15}$, $R_{16}$ and $R_{17}$ may be the same or different and each represents a hydrogen atom, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group or an aryloxycarbonyl group.

6. A multilayer silver halide color photographic material according to claim 5, wherein magenta coupler of the general formula (II) represents compounds of the general formulae (II-a), (II-d) or (II-e).

7. A multilayer silver halide color photographic material according to claim 1, wherein magenta coupler of the general formula (II) represents compound of the general formula (M-13), (M-17) or (M-40):

(M-13)
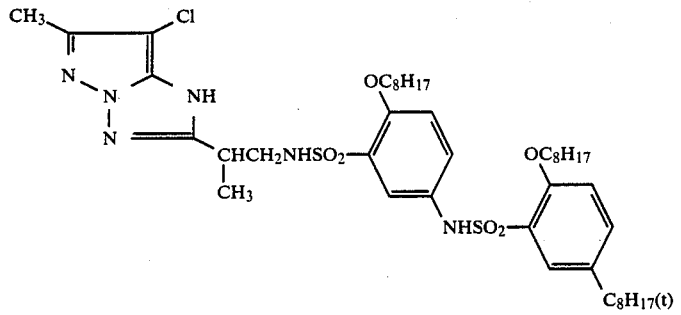
(M-17)
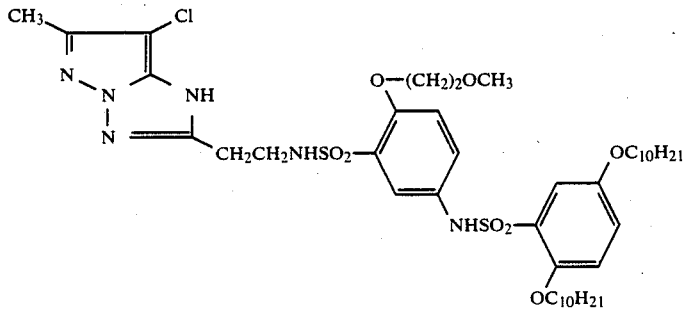
(M-40)
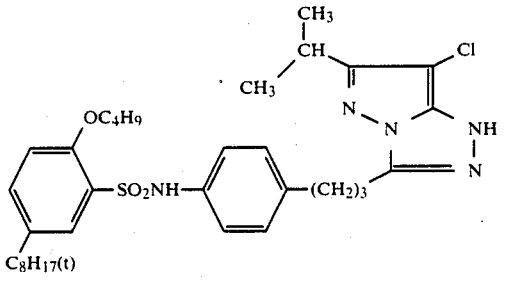
8. A multilayer silver halide color photographic material according to claim 1, wherein $R_3$ in the general formula (III) represents an aliphatic group having 1 to 31 carbon atoms or an aryl group.
9. A multilayer silver halide color photographic material according to claim 1, wherein a compound of the general formulae (A) or (B) represents anti-color-fading agents Nos. 20 and 23:
20
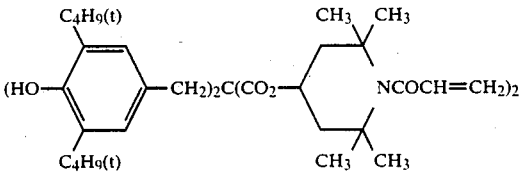
23
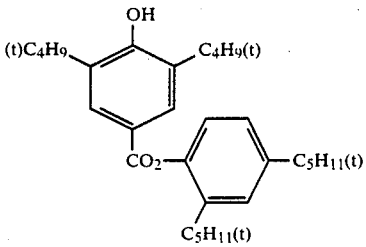
* * * * *